US009263012B2

(12) United States Patent
Truchsess et al.

(10) Patent No.: US 9,263,012 B2
(45) Date of Patent: Feb. 16, 2016

(54) CYMBAL STRIKING SURFACE

(71) Applicant: Avedis Zildjian Co., Norwell, MA (US)

(72) Inventors: Julia D. Truchsess, Sandy Hook, CT (US); Paul Francis, Plymouth, MA (US); John V. Roderick, Marshfield, MA (US)

(73) Assignee: Avedis Zildjian Co., Norwell, MA (US)

( * ) Notice: Subject to any disclaimer, the term of this patent is extended or adjusted under 35 U.S.C. 154(b) by 0 days.

(21) Appl. No.: 14/218,218

(22) Filed: Mar. 18, 2014

(65) Prior Publication Data

US 2015/0269921 A1 Sep. 24, 2015

(51) Int. Cl.

| | |
|---|---|
| ***G10H 1/32*** | (2006.01) |
| ***G10H 3/00*** | (2006.01) |
| ***G10D 13/06*** | (2006.01) |

(52) U.S. Cl.

CPC ..... *G10D 13/06* (2013.01); *G10H 2230/321* (2013.01)

(58) Field of Classification Search

CPC ..... G10D 13/06; G10H 2230/321
USPC ..... 84/743, 402
See application file for complete search history.

(56) References Cited

U.S. PATENT DOCUMENTS

| | | | | |
|---|---|---|---|---|
| 4,248,129 | A * | 2/1981 | Zildjian | 84/422.1 |
| 4,809,581 | A * | 3/1989 | Paiste et al. | 84/402 |
| 6,720,491 | B1 * | 4/2004 | Kroncke | 84/422.3 |
| 2002/0059861 | A1 * | 5/2002 | Yoshino et al. | 84/402 |
| 2005/0039593 | A1 * | 2/2005 | Wachter | 84/730 |
| 2005/0155483 | A1 * | 7/2005 | Anderson | 84/422.3 |
| 2005/0257663 | A1 * | 11/2005 | Wachter | 84/411 M |
| 2009/0139387 | A1 * | 6/2009 | Toda | 84/422.3 |
| 2010/0024624 | A1 * | 2/2010 | Wachter | 84/422.3 |
| 2012/0144980 | A1 * | 6/2012 | Roderick et al. | 84/723 |
| 2013/0125735 | A1 * | 5/2013 | Mori | 84/723 |
| 2013/0312590 | A1 * | 11/2013 | Truchsess | 84/725 |
| 2014/0116227 | A1 * | 5/2014 | Yoshino | 84/402 |
| 2014/0298978 | A1 * | 10/2014 | Yoshino | 84/743 |

* cited by examiner

*Primary Examiner* — Jeffrey Donels
(74) *Attorney, Agent, or Firm* — Wolf, Greenfield & Sacks, P.C.

(57) ABSTRACT

According to some aspects, a cymbal is provided comprising a metal plate having a plurality of perforations therein, and a coating of a resilient material in contact with the metal plate that covers at least a portion of the surface of the metal plate. According to some aspects, a cymbal is provided comprising a metal plate, and a dampening element attached to at least a portion of the circumference of the metal plate. According to some aspects, a method of producing a cymbal is provided, comprising forming a metal plate having a plurality of perforations therein, and forming a resilient material over at least a portion of the surface of the metal plate and in contact with the metal plate.

20 Claims, 13 Drawing Sheets

CYMBAL STRIKING SURFACE

BACKGROUND

Conventional acoustic drum sets are typically quite loud. In particular, metal cymbals, which typically comprise part of such a drum set, generate a high volume sound, often over a period of several seconds. A drummer wishing to practice drumming skills will generally therefore produce a lot of noise.

So-called "electronic drum kits" comprise pads that produce little audible sound when struck and typically consist of a material such as rubber. In particular, "electronic cymbals" are typically blocks of rubber that include mechanical switches at different locations on or nearby the cymbal. The switches may be located at various positions so that when the cymbal is struck, the movement of the cymbal causes one or more of the switches to be engaged.

SUMMARY

Some embodiments provide a cymbal comprising a metal plate having a plurality of perforations therein, and a coating of a resilient material in contact with the metal plate that covers at least a portion of the surface of the metal plate.

Some embodiments provide a cymbal comprising a metal plate, and one or more dampening elements each attached to at least a portion of the circumference of the metal plate.

Some embodiments provide a cymbal comprising a metal plate, and a dampening element mechanically coupled to the surface of the metal plate that reduces the amplitude of acoustic waves generated by a strike of the metal plate while retaining natural vibratory properties of the metal plate.

Some embodiments include a method of producing a cymbal, comprising forming a metal plate having a plurality of perforations therein, and forming a resilient coating over at least a portion of the surface of the metal plate and in contact with the metal plate.

Some embodiments include a method of producing a cymbal, comprising forming a metal plate, and mechanically coupling a dampening element to a portion of the circumference of the metal plate.

The foregoing is a non-limiting summary of the invention, which is defined only by the appended claims.

BRIEF DESCRIPTION OF DRAWINGS

The accompanying drawings are not intended to be drawn to scale. In the drawings, each identical or nearly identical component that is illustrated in various FIGs. is represented by a like numeral. For purposes of clarity, not every component may be labeled in every drawing. In the drawings.

DETAILED DESCRIPTION

Figure 1:
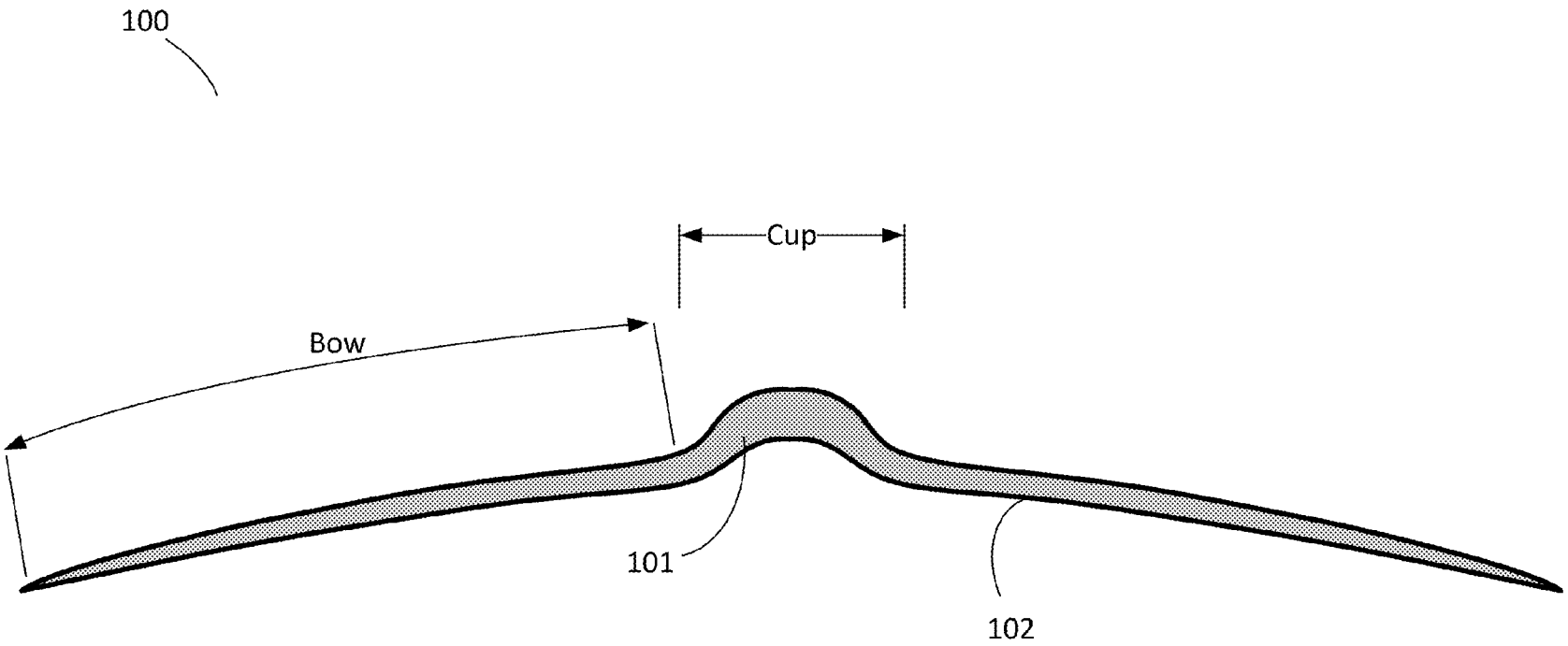
FIG. 1 illustrates a cross-section of an exemplary low volume cymbal suitable for practicing some embodiments.

The inventors have recognized and appreciated that a low volume cymbal may be formed that produces a low acoustic volume when struck yet exhibits some natural vibratory properties of a traditional acoustic cymbal. For example, a low volume cymbal may produce a sound having a volume lower than that of a traditional acoustic cymbal while retaining, or substantially retaining, the sustain of a traditional acoustic cymbal.

The inventors have further recognized and appreciated that a low volume cymbal having the feel of a traditional cymbal may be manufactured using simple manufacturing methods, and may in some cases be manufactured using low-cost materials.

Conventional low volume cymbals are typically made of a dense material such as rubber, and include one or more switches to register a strike of the cymbal. Consequently, conventional low volume cymbals require involved wiring and are mechanically complex. In addition, conventional low volume cymbals may not feel to a player like a traditional acoustic (metal) cymbal and may also not be as aesthetically pleasing as a traditional acoustic cymbal. A metal-based low volume cymbal may, in contrast, provide a player with a playing experience similar to that of a traditional acoustic cymbal.

In some embodiments, a low volume cymbal as described herein may form part of an electronic cymbal system by analyzing an acoustic signal generated by a strike of the cymbal to determine a manner in which the cymbal was struck. The inventors have recognized and appreciated that by reducing the volume of sound produced by a strike of a cymbal, an acoustic analysis may be more effectively performed on the resulting sound. For example, a transducer may be coupled to a low volume cymbal as described herein to convert acoustic energy into electrical energy that is indicative of a manner in which the cymbal was struck. Acoustic signals as described herein may include any type of longitudinal wave or waves propagating through any medium or media, such as, but not limited to, sound waves, acoustic waves, surface acoustic waves (SAWs), Rayleigh waves, and/or combinations thereof.

The inventors have further recognized and appreciated that a low volume cymbal may be formed from a metal plate coupled to a dampening element. By providing a dampening element that reduces the volume of sound resulting from a strike of the cymbal while retaining some vibratory properties of the metal, a low volume cymbal with the playing feel of a traditional cymbal may be formed.

In some embodiments, a dampening element comprises a resilient material applied to the surface of a metal cymbal, for example as a coating. The inventors have recognized and appreciated that particular materials, when applied to the surface of a metal cymbal, may reduce the volume of sound resulting from a strike to the cymbal while retaining some vibratory properties of the metal.

In some embodiments, a dampening element comprises a resilient material that includes two or more layers. For example, a first layer may be applied to the surface of a cymbal and a second layer may be applied to the first layer and/or to the surface of the cymbal. It may be beneficial in some use cases to provide, as a component of the dampening element, a layer having a high hardness (e.g., a high indentation and/or rebound hardness) on the exterior of at least part of a low volume cymbal. In such cases, a player of the low volume cymbal may repeatedly strike the cymbal without damaging, or substantially without damaging, the dampening element by directing strikes to the hard layer.

In some embodiments, a dampening element comprises a ring of material situated around the circumference of a cymbal. The inventors have recognized and appreciated that particular materials, when added to the circumference of a metal cymbal, inhibit the acoustic volume resulting from a strike of the cymbal while retaining some vibratory properties of the metal.

In some embodiments, a dampening element comprises a ring of material situated around a portion of the circumference of a cymbal. By placing a dampening element around a portion of the circumference of a cymbal, natural vibratory properties of the cymbal may be better retained compared with a dampening element placed around the complete circumference of the cymbal, and/or may provide an improved aesthetic playing feel, since a player may strike an area of the cymbal that does not include the dampening element, thus providing a playing experience substantially similar to, or identical to, that of a traditional acoustic cymbal.

The inventors have further recognized and appreciated that one or more perforations in a metal cymbal may reduce the volume of sound resulting from a strike to the cymbal while retaining some natural vibratory properties of the cymbal. By reducing the amount of material present in the cymbal, the volume of sound resulting from a strike of the cymbal may be reduced while retaining some acoustic properties.

Techniques described herein may be applicable to use cases in which it is desirable to play a cymbal quietly yet for the cymbal player to adequately hear the response of the cymbal. For example, during practice playing in a home environment, a player may wish to experience the feel of a traditional acoustic cymbal yet it may be undesirable to produce the volume level typically associated with a traditional acoustic cymbal.

In some embodiments, a low volume cymbal comprises a lightweight metal such as steel. The inventors have recognized and appreciated that a low volume cymbal need not, in some use cases, produce sound that is as rich and complex as a traditional fine bronze cymbal. Accordingly, in some use cases it may be beneficial to produce a low volume cymbal using a cheap and/or workable metal, such as steel.

Following below are more detailed descriptions of various concepts related to, and embodiments of, a low volume cymbal. It should be appreciated that various aspects described herein may be implemented in any of numerous ways. Examples of specific implementations are provided herein for illustrative purposes only. In addition, the various aspects described in the embodiments below may be used alone or in any combination, and are not limited to the combinations explicitly described herein.

FIG. 1 illustrates a cross-section of an exemplary low volume cymbal suitable for practicing some embodiments. Low volume cymbal 100 includes cymbal 101 and coating 102. Cymbal 101 may be of any suitable shape, though in some embodiments may include a bell or "cup" region in the center of the cymbal and/or a "bow" region around the exterior of the cymbal, both of which are indicated in the example of FIG. 1. It should be appreciated that in general, cymbals discussed herein may be of any suitable size and/or shape, though may in some embodiments have the general form shown in FIG. 1. The specific dimensions of each region may be of any suitable size, both in terms of absolute sizes and relative sizes. For example, a cymbal having a small or negligible cup region may be used with embodiments described herein.

Cymbal 101 may comprise any suitable material, or combination of materials. In some embodiments, cymbal 101 is constructed from a material that is suitably rigid so as to produce sounds when struck and/or has a hardness such that repeated strikes of the cymbal will not significantly dent or damage the material. In some embodiments, cymbal 101 comprises a metal. In some embodiments, cymbal 101 comprises bronze, which may include any formulation of a bronze alloy comprising any proportions of copper and tin in addition to any number and any type of other substances. Suitable bronze alloys may include, but are not limited to, 92% copper and 8% tin alloys (commonly known as "B8"), 80% copper and 20% tin alloys (commonly known as "B20"), Paiste Sound Alloy, bronze comprising between 70% copper and 100% copper by volume and/or by weight, bronze comprising between 0% and 30% tin by volume and/or by weight, bronze comprising silver, and/or any combinations thereof.

Cymbal 101 may be of any suitable size and/or shape. In the example of FIG. 1, cymbal 101 is circular when viewed from above and has a cross-section including the bow and cup regions shown. However, cymbal 101 is not limited to cymbals that have this particular shape or cross-section, and it will be appreciated that the particular shape of cymbal depicted in FIG. 1 is provided merely as an example. Moreover, cymbal 101 may be of any suitable size, including diameters between 6 inches and 30 inches, and thicknesses between 1 mm and 10 mm. However, cymbal 101 may also be a vertically mounted gong, for example, and have a diameter between 1 foot and 6 feet.

In some embodiments, cymbal 101 is of a size and shape corresponding to a particular categorization of cymbal types, including, but not limited to, cymbals commonly known as a ride, a crash, a hi-hat, a crash/ride, a splash, a China cymbal, and/or a marching cymbal. It will be appreciated that cymbal types, including those indicated above, may be formed in a variety of shapes and sizes, and that the types indicated are broad categorizations known to those of skill in the art.

Coating 102 may comprise any suitable material that can be coupled to at least a part of the surface of cymbal 101 and that dampens, at least to some extent, vibrations of the cymbal. Coating 102 may reduce an amplitude of acoustic waves generated by a strike of low volume cymbal 100 while substantially retaining the playing feel that would be provided by cymbal 101 in the absence of coating 102.

In some embodiments, coating 102 includes multiple components and/or materials. For example, coating 102 may comprise a plurality of layers. In some embodiments, coating 102 may comprise a first layer in contact with one or more other layers and/or cymbal 101. For example, coating 102 may include a first layer in contact with at least part of cymbal 101 and a second layer in contact with at least part of the first layer. Coating 102 may, in some cases, include a first material applied to a first portion of cymbal 101 and a second material applied to a second portion of cymbal 101, and that the first and section portions may, or may not, be overlapping. While, in the example of FIG. 1, coating 102 is shown as completely covering the surface of cymbal 101, it will be appreciated that a low volume cymbal may be formed by covering only a portion of the surface of a cymbal.

In some embodiments, coating 102 comprises a resilient material. It may be desirable that low volume cymbal 100 have some resistance to repeated strikes, since over its lifetime it will likely be struck many times by one or more players. Accordingly, coating 102 may be resilient, which may include, though is not limited to, the exhibition of properties such as a high hardness (including scratch, indentation and/or rebound hardness), a high tensile strength, a high modulus of elasticity, a high compressive yield strength, and/or combinations thereof. For example, coating 102 may comprise a resilient material having a hardness between 20 and 500 on the Brinell scale; coating 102 may comprise a resilient material having a tensile strength between 50 MPa and 1000 MPa; coating 102 may comprise a resilient material having a modulus of elasticity between 100 MPa and 100 GPa; and/or coating 102 may comprise a resilient material having a compressive yield strength between 50 MPa and 2000 MPa.

In some embodiments, coating 102 comprises a resilient material formed from a plurality of materials. Not all components of the resilient material in such embodiments need be resilient, however. For example, a first material layer may have a low resilience and a second material layer exterior to the first layer may be resilient, such that the combination of the two layers has a resilience due to the resilience of the exterior material layer. Moreover, coating 102 may include a plurality of materials combined together in a structure other than one comprising layers with the net resulting material being resilient even while not every material in the combination may itself be necessarily resilient. For example, a material having a low resilience and a resilient material may be intermixed in some manner, resulting in a resilient material suitable for use in coating 102.

Coating 102 may be of any suitable thickness. For example, coating 102 may have a thickness between 1 μm and 10 mm; for example between 1 mm and 5 mm. Coating 102 may have a homogeneous thickness across an area of cymbal 101 to which it is applied, though may alternatively, or additionally, have a thickness that varies across the cymbal. For example, coating 102 may have a greater thickness toward an exterior circumference of cymbal 101 than a thickness at or close to the center of cymbal 101. Where coating 102 comprises multiple components and/or materials, each component and/or material may have any suitable thickness or thicknesses.

In some embodiments, coating 102 comprises one or more of: solvents, pigments, dyes, resins, lubricants, solubilizers, surfactants, particulate matter, fluorescers, or combinations thereof. For example, coating 102 may comprise an ink that has been applied to cymbal 101.

In some embodiments, coating 102 comprises an elastomer, such as rubber. An elastomeric component of coating 102 may, in some use cases, provide a protective layer around other components of coating 102 and/or may serve to seal said other components between itself and cymbal 101 (e.g., to protect said components). Furthermore, an elastomeric component of coating 102 may dampen vibrations of cymbal 101 alone, or in addition to, any other components of coating 102.

In some embodiments, coating 102 comprises a metal. For example, coating 102 may comprise a metal plated to cymbal 101 and/or to another component of coating 102. In some embodiments, coating 102 comprises a nickel plating.

Coating 102 may be applied to cymbal 101 via any suitable technique or techniques. Coating 102 may comprise multiple layers and/or multiple materials which may be applied to cymbal 101 in sequence, and/or may be combined separately and then applied to cymbal 101.

In some embodiments, coating 102 comprises a first layer which dampens vibrations of cymbal 101 and a second layer applied over at least part of the first layer, which further dampens vibrations of cymbal 101, and which may also provide a protective coating. For example, coating 102 may comprise an ink applied to the surface of cymbal 101 and an elastomeric coating applied over the ink. Since some components of coating 102 may provide desirable dampening qualities but may be damaged or otherwise degraded upon repeated strikes of low volume cymbal 100, in some use cases in may be beneficial to include a protective component in coating 102 which can be substantially undamaged by repeated strikes. For example, any one or more of the resilient qualities discussed above (high hardness, etc.) may be utilized in such a protective coating.

Low volume cymbal 100 may produce different types of sound depending on where it is struck. While there are essentially infinite variations in the types of sound, for musical purposes cymbal strikes may be divided into at least three broad categories, including "bell", "bow", and "edge" strikes. Bell strikes are achieved by striking the cymbal near its center, on or around the bell or "cup" region. Bow strikes are achieved by striking the main body of the cymbal with the tip of a stick. Edge strikes are achieved by striking the edge of the cymbal with the side of a stick's shaft. In addition to the various strike types the cymbal may be silenced by grasping the edge of the cymbal (e.g., with a hand), causing vibrations to cease or to at least be significantly damped. This is referred to as "choking" the cymbal. The various strike types and choking are collectively referred to as the instrument's "articulations." In some embodiments, low volume cymbal 100 may be coupled to a transducer which detects an acoustic signal generated by a strike of cymbal 101, as will be described further below.

Figure 2:
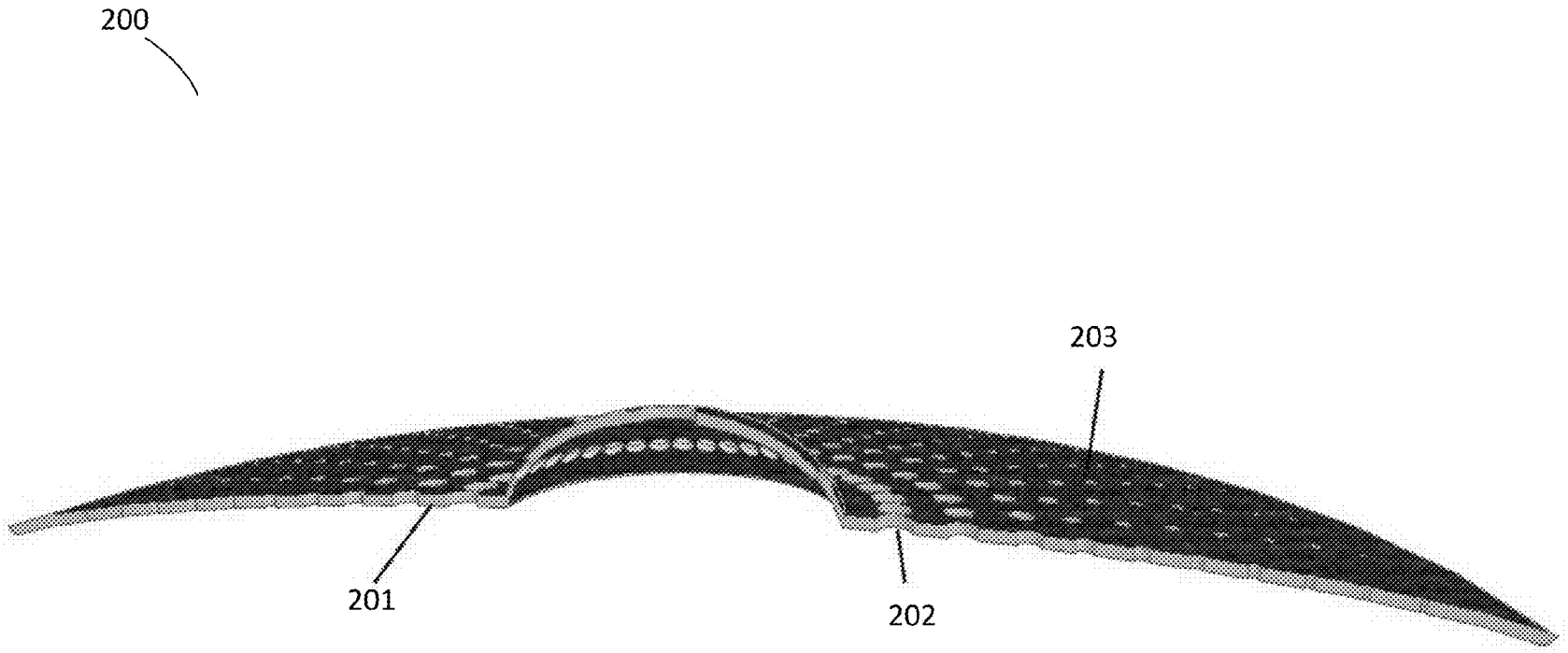
FIG. 2 illustrates a cross-section of an exemplary perforated low volume cymbal suitable for practicing some embodiments.

FIG. 2 illustrates a cross-section of an exemplary perforated low volume cymbal suitable for practicing some embodiments. Low volume cymbal 200 includes cymbal 201 having perforations such as exemplary perforation 202, and includes coating 203. Cymbal 201 may include any cymbal described herein, including any cymbal having any properties described above in connection with cymbal 101 shown in FIG. 1. In some embodiments, cymbal 201 comprises bronze, such as B8 bronze. Coating 203 may include any coating described herein, including a coating having any properties described above in connection with coating 102 shown in FIG. 1.

In the example of FIG. 2, cymbal 201 may include any number of perforations, in any location or locations, which may be of any suitable size. Perforation 202 is labeled as merely one example perforation shown in the exemplary embodiment of FIG. 2. Perforations of cymbal 201 may serve to reduce the volume resulting from a strike of the cymbal by reducing the amount of the metal present in the cymbal while retaining some natural vibratory properties of the cymbal. Some exemplary configurations of suitable perforations are exhibited by the Gen16 line of cymbals manufactured by Avedis Zildjian Co., Norwell, Mass.

In some embodiments, cymbal 201 includes perforations having different sizes and/or shapes. For example, cymbal 201 may include one or more perforations of a first size and one or more perforations of a second size. In general, however, perforations may be of any size, such as having diameters between 1 mm and 50 mm.

In some embodiments, cymbal 201 includes one or more perforations that have a circular cross-section. The circular perforations may be of any suitable size and may be located at any suitable location or locations.

Coating 203 may be applied within one or more perforations of cymbal 201, or may be applied only to an exterior surface (or exterior surfaces) of the cymbal. For example, as shown in FIG. 2 coating 203 may coat the exterior surface of cymbal 201 yet not coat the interior surfaces of perforations within cymbal 201. However, coating 203 may also be applied within any portion of the perforations of cymbal 201, including some, all or none. Moreover, coating 203 may be applied to only a portion of an interior surface of one or more perforations, the portion being less than the full interior surface of the perforation.

As discussed above, a low volume cymbal such as low volume cymbal 200 may be coupled to a suitable transducer which detects an acoustic signal resulting from a strike of the cymbal. In some embodiments, one or more perforations of cymbal 201 may be used to mount such a transducer. For example, a transducer may be fashioned such that it may be slotted into one or more perforations of cymbal 201. Alternatively, or additionally, one or more perforations of cymbal 201 may provide a mounting point for a fastener to which a transducer is coupled.

It will be appreciated that, while the example of FIG. 2 depicts a low volume cymbal having both perforations and a coating, a low volume cymbal as described herein may be formed from a cymbal having perforations alone. For example, while coating 203 may provide additional dampening of vibrations of cymbal 201, a low volume cymbal may, in some use cases, not include a coating and may make use of only the perforations of cymbal 201 to reduce the volume of the cymbal.

Figure 3A:
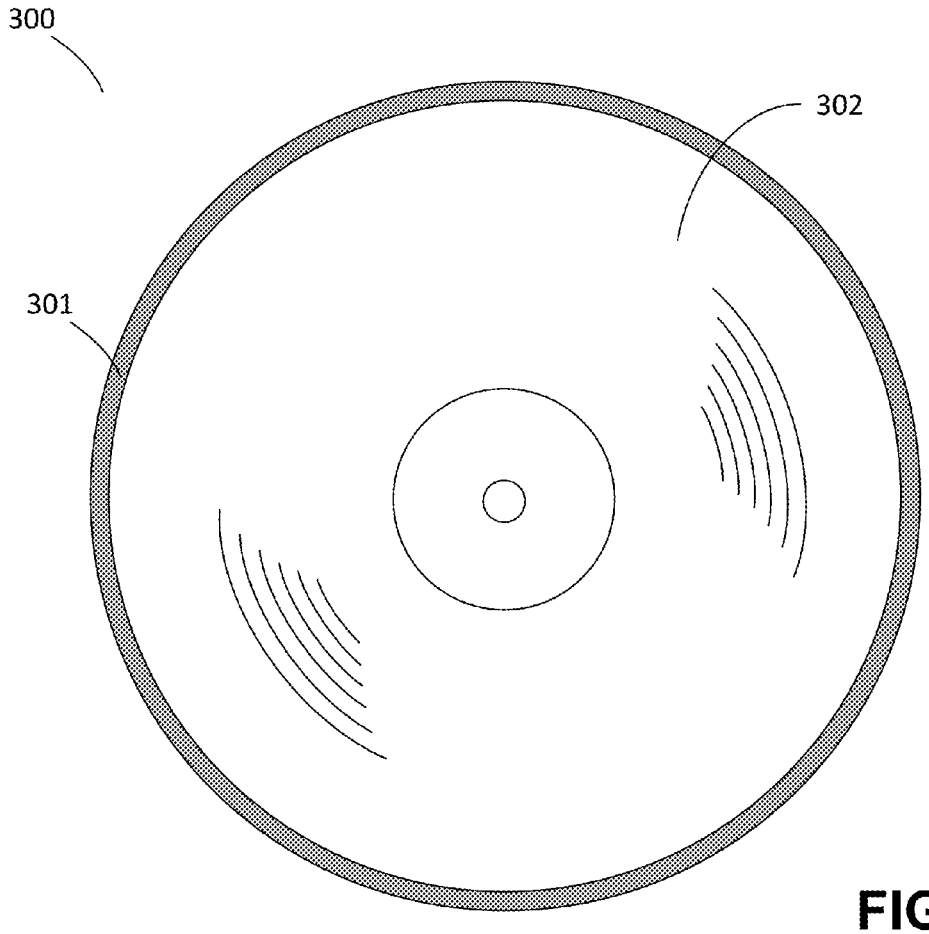
FIGS. 3A-B depict top and side views, respectively, of a low volume cymbal having a circumferential dampening, according to some embodiments.
Figure 3B:
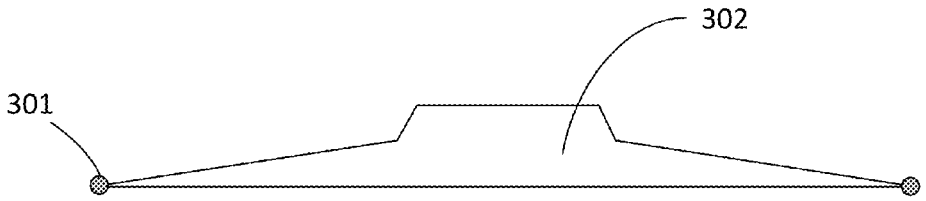

FIG. 3A depicts a top view of a low volume cymbal having a circumferential dampening element, according to some embodiments. FIG. 3B depicts a side view of the low volume cymbal shown in FIG. 3A, according to some embodiments. Low volume cymbal 300 includes cymbal 302 and dampening element 301.

Cymbal 302 may include any cymbal described herein, including a cymbal having any properties described above in connection with cymbal 101 shown in FIG. 1 and/or cymbal 201 shown in FIG. 2. In addition, cymbal 302 may include one or more features provided in low volume cymbal 100 and/or low volume cymbal 200, as discussed above. For example, cymbal 302 may include a coating such as coating 102 and/or coating 203, and/or may include one or more perforations as shown in FIG. 2 and discussed above.

Dampening element 301 is coupled to a circumference of cymbal 302. Dampening element 301 may be any suitable material that dampens vibrations of cymbal 302. For example, dampening element 301 may include a plastic such as, but not limited to, one or more of acrylic, polyester, silicone, polyurethane, halogenated plastic, or combinations thereof. Additionally, or alternatively, dampening element 301 may include an elastomer, such as rubber.

In some use cases, may be beneficial for dampening element 301 to have some resilience to strikes, for example by a player of low volume cymbal 300. Since dampening element 301 surrounds the perimeter of cymbal 302 in the example of FIGS. 3A-B, a player of cymbal 300 will likely strike dampening element 301 numerous times during playing. Accordingly, in some embodiments dampening element 301 may be sufficiently resilient so as not to be damaged by a strike of cymbal 300.

In the example of FIGS. 3A-3B, dampening element 301 is attached to a full circumference of exemplary cymbal 302. It will be appreciated, however, that dampening element 301 may be attached to any portion of the circumference of cymbal 302, and moreover, may be attached to one or more locations on the body of cymbal 302. For example, a dampening element in the form of a ring having a diameter less than that of cymbal 302 may be positioned at any point on the surface of cymbal 301.

In some embodiments, cymbal 302 is a metal cymbal. For example, cymbal 302 may comprise bronze, such as B8 bronze. It may be beneficial in some use cases to utilize a conventional metal acoustic cymbal as cymbal 302, and to couple dampening element 301 to said cymbal. For example, the manufacture of such a low volume cymbal may utilize existing cymbal technology in addition to a suitable dampening element as described herein.

Dampening element 301 may comprise any number of components and may be situated in any number of locations on the cymbal 302. For example, dampening element 301 may include a ring coupled to the circumference of cymbal 302 in addition to one or more components coupled to other locations of the cymbal.

Dampening element 301 may be coupled to cymbal 302 in any suitable way. In some embodiments, dampening element 301 is coupled to cymbal 302, at least in part, via a glue, an adhesive and/or other fixative. For example, dampening element 301 may contact cymbal 302 at a plurality of locations, and at one or more of those locations, the dampening element may be affixed to the cymbal.

In some embodiments, dampening element 301 is coupled to cymbal 302, at least in part, via one or more mechanical fasteners. Such fasteners may include, but are not limited to, clamps, clips, cable ties, clasps, pins, toggle bolts, staples, stitches, or combinations thereof. In embodiments where cymbal 302 is a perforated cymbal, dampening element 301 may, for example, be coupled to the cymbal by attaching one or more mechanical fasteners through one or more of the perforations and around at least a portion of the dampening element.

Dampening element 301 may be formed in any suitable cross-sectional shape. For example, dampening element 301 may form a circle, a disc, a square, a rectangle, or any other suitable shape in cross-section. Dampening element 301 may contact cymbal 302 at any number of points, which may depend in part on the shape of dampening element 301.

Dampening element 301 may be coupled to cymbal 302 at any number of coupling points. For example, dampening element 301 may contact cymbal 302 at a number of points, however coupling via any of the techniques described herein may occur at a subset of those points, or may occur at every such point. For example, dampening element 301 may be coupled to cymbal 302 at periodic locations around the dampening element, such as every 60° around the circumference.

As discussed above, a dampening element may reduce a volume of a cymbal to which it is coupled while allowing the cymbal to retaining some natural vibratory properties of the cymbal. A dampening element having the particular form shown in the example of FIGS. 3A-3B may additionally offer the benefit of protecting cymbal 302 from damage in certain use cases. For example, dampening element 301 may protect cymbal 302 from damage, at least in part, during storage of low volume cymbal 300 and/or if low volume cymbal 300 is dropped.

Figure 4A:
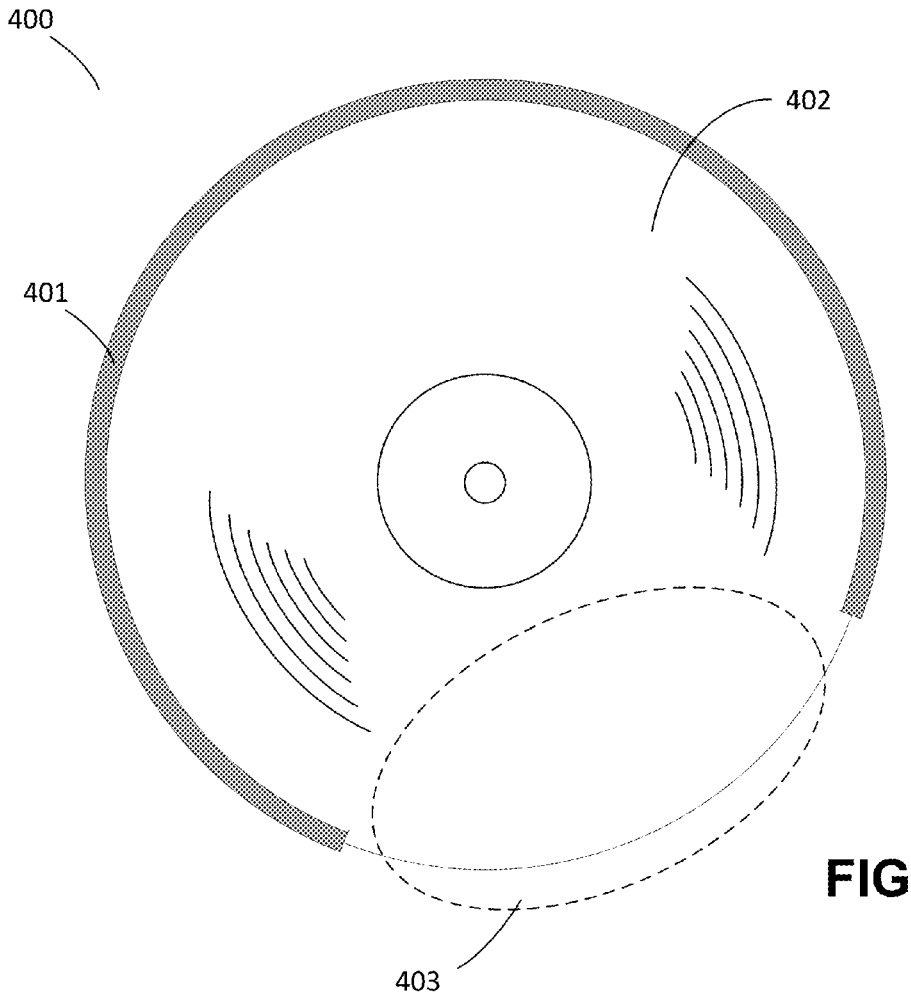
FIGS. 4A-B depict top and side views, respectively, of a low volume cymbal having a partial circumferential dampening element, according to some embodiments.
Figure 4B:
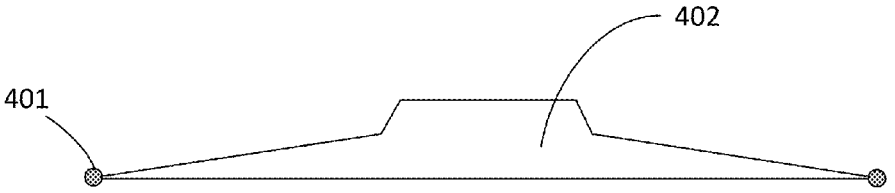

FIG. 4A depicts a top view of a low volume cymbal having a partial circumferential dampening element, according to some embodiments. FIG. 4B depicts a side view of the low volume cymbal shown in FIG. 4A, according to some embodiments. Low volume cymbal 400 includes cymbal 402 and dampening element 401.

Cymbal 402 may include any cymbal described herein, including a cymbal having any properties described above in connection with cymbal 101 shown in FIG. 1 and/or cymbal 201 shown in FIG. 2. In addition, cymbal 402 may include any features provided in low volume cymbal 100 and/or low volume cymbal 200, as discussed above. For example, cymbal 402 may include a coating such as coating 102 and/or coating 203, and/or may include one or more perforations as shown in FIG. 2 and discussed above.

Dampening element 401 may have any suitable properties and/or features, including any of those described above in relation to dampening element 301 shown in FIGS. 3A-3B. However, in the example of FIGS. 4A-4B, dampening element 401 forms a partial circumference around cymbal 402. Dampening element 401 may form an arc of any suitable size around the circumference of cymbal 402; for example, the dampening element may subtend an angle between 180° and 360°, such as approximately 270°.

Dampening element 401 may, in some use cases, offer one or more benefits compared with dampening element 301 shown in FIGS. 3A-3B. In some use cases, for example, it may be preferred that a player of low volume cymbal 400 can freely strike the open area 403 rather than strike an area of the low volume cymbal that includes a portion of dampening element 401. For example, if dampening element 401 is not highly resistant to strikes by a player of low volume cymbal 400, it may be beneficial to provide a region of low volume cymbal 400 that may be struck by a player without striking the dampening element. Accordingly, dampening element 401 may allow for a greater range of materials for use compared with dampening element 301. Furthermore, allowing a player of low volume cymbal 400 to strike open area 403 may provide a playing experience similar or identical to that of a traditional acoustic cymbal, irrespective of whether cymbal 402 comprises a coating and/or perforations, while still reducing the volume of the cymbal.

In the examples of FIGS. 3A-B and FIGS. 4A-B, dampening elements 301 and/or 401 may be coupled to areas of cymbal 302 or cymbal 402, respectively, located in an outer region of the respective cymbal, that is not necessarily an edge of the cymbal. As such, it will be appreciated that while the descriptions of dampening elements 301 and/or 401 provided above describe elements being coupled to the circumference of a respective cymbal, the dampening element in question may be generally provided to any outer region of the cymbal. For example, dampening elements 301 and/or 401 may be provided to an outer 20% of a cymbal, and/or may be coupled to an annular area having an outer radius equal to that of the respective cymbal and an inner radius equal to 80% of the cymbal's radius. Accordingly, a dampening element may be coupled, at least in part, to an outer 20% of a cymbal yet may, for the purposes of the description provided herein, be considered to be attached to the circumference of the cymbal. Further examples of such coupling are described below.

FIGS. 5A-D illustrate exemplary forms of dampening elements suitable for use in a low volume cymbal, according to some embodiments. In the examples below, a cross-section of a dampening element suitable for use in a low volume cymbal is depicted, however it will be appreciated that the cross-sections shown may not be representative of other cross-sections through the same dampening element. For example, dampening elements shown may not extend around an entire circumference of the cymbal to which it is coupled, just as dampening element 401 shown in FIGS. 4A-4B provides only a partial circumference of cymbal 402. Alternatively, or additionally, dampening elements shown may have different cross-sections at different locations, such as a circular cross-section at one location and an elliptical cross-section at another location. It will further be appreciated that dampening elements described in the examples of FIGS. 5A-D are depicted having particular cross-sections (e.g., dampening element 502 shown in FIG. 5A has a square cross-section), but that in general the dampening elements depicted may have any suitable cross-section(s), as the invention is not limited to any particular cross-sectional shape.

Figure 5A:
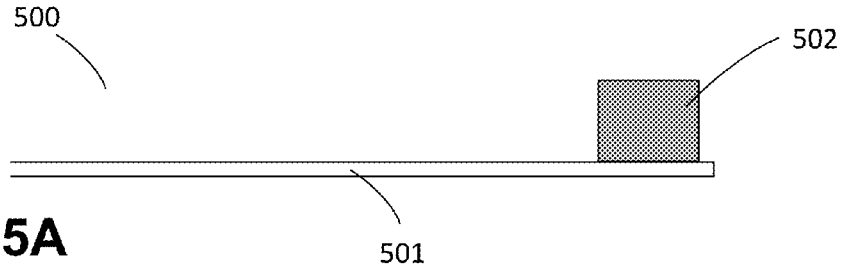
FIGS. 5A-D illustrate exemplary cross-sections of dampening elements suitable for use in a low volume cymbal, according to some embodiments.

FIG. 5A depicts low volume cymbal 500 comprising cymbal 501 coupled to dampening element 502. Cymbal 501 may include any cymbal described herein, including a cymbal having any properties described above in connection with cymbal 101 shown in FIG. 1 and/or cymbal 201 shown in FIG. 2. For example, cymbal 501 may comprise a coating, perforations, or neither perforations nor a coating. Furthermore, low volume cymbal 500 may include any number of dampening elements, as dampening element 502 is provided as an example merely to indicate one possible form of a suitable dampening element.

In the example of FIG. 5A, dampening element 502 has a rectangular cross-section and is coupled to an upper surface of cymbal 501. Dampening element 502 may be coupled to cymbal 501 using any suitable technique(s), including via one or more mechanical fasteners, and/or via a glue or other fixative, as described above. In the example of FIG. 5A, dampening element 502 is depicted at an edge of cymbal 501, however it will be appreciated that dampening element 502 may be situated at any suitable position along an upper surface of cymbal 501. For example, dampening element 502 may be situated within the outer 20% of the radius of cymbal 501 (e.g., within an annulus having an inner radius equal to 80% of the radius of the cymbal).

Figure 5B:
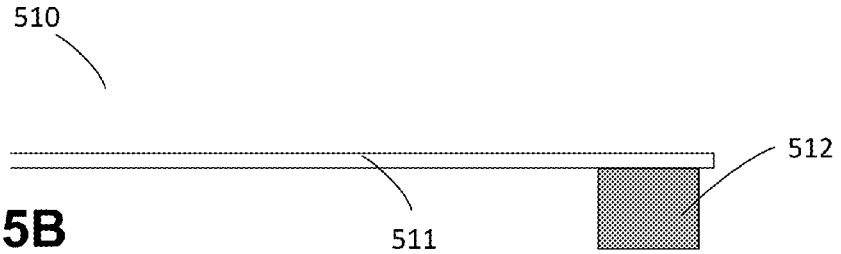

FIG. 5B depicts low volume cymbal 510 comprising cymbal 511 coupled to dampening element 512. Cymbal 511 may include any cymbal described herein, including a cymbal having any properties described above in connection with cymbal 101 shown in FIG. 1 and/or cymbal 201 shown in FIG. 2. For example, cymbal 511 may comprise a coating, perforations, or neither perforations nor a coating. Furthermore, low volume cymbal 510 may include any number of dampening elements, as dampening element 512 is provided as an example merely to indicate one possible form of a suitable dampening element.

In the example of FIG. 5B, dampening element 512 has a rectangular cross-section and is coupled to a lower surface of cymbal 511. Dampening element 512 may be coupled to cymbal 511 using any suitable technique(s), including via one or more mechanical fasteners, and/or via a glue or other fixative, as described above. In the example of FIG. 5B, dampening element 512 is depicted at an edge of cymbal 511, however it will be appreciated that dampening element 512 may be situated at any suitable position on the lower surface of cymbal 511. For example, dampening element 512 may be situated within the outer 20% of the radius of cymbal 511 (e.g., within an annulus having an inner radius equal to 80% of the radius of the cymbal). In some embodiments, dampening element 512 is situated within an annulus having an inner radius equal to 80% of the radius of cymbal 511 and having an outer radius equal to 95% of the radius of the cymbal.

Dampening element 512 may be beneficial for use cases in which the dampening element is not formed from a material resistant to strikes by a player of low volume cymbal 510. Since dampening element 512 is provided only on the underside of cymbal 511, a player of low volume cymbal 510 will likely not strike the dampening element.

Figure 5C:
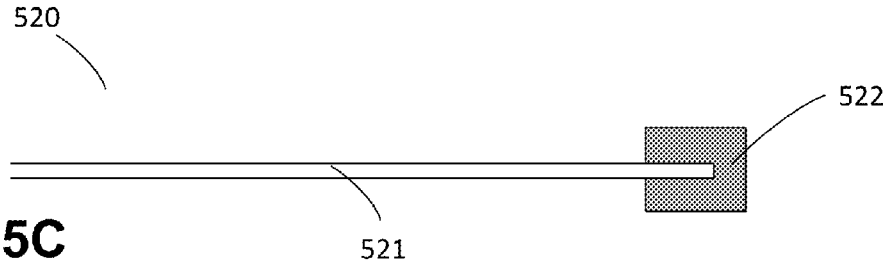

FIG. 5C depicts low volume cymbal 520 comprising cymbal 521 coupled to dampening element 522. Cymbal 521 may include any cymbal described herein, including a cymbal having any properties described above in connection with cymbal 101 shown in FIG. 1 and/or cymbal 201 shown in FIG. 2. For example, cymbal 521 may comprise a coating, perforations, or neither perforations nor a coating. Furthermore, low volume cymbal 520 may include any number of dampening elements, as dampening element 522 is provided as an example merely to indicate one possible form of a suitable dampening element.

In the example of FIG. 5C, dampening element 522 has a substantially rectangular cross-section and is coupled to cymbal 521 via a notch in the element such that dampening element 522 contacts both the upper and lower surface of the cymbal. Dampening element 522 may be coupled to cymbal 521 using any suitable technique(s), including via one or more mechanical fasteners, and/or via a glue or other fixative, as described above. In the example of FIG. 5C, dampening element 522 is depicted having roughly equal volume above and below the plane of cymbal 521, however it will be appreciated that dampening element 522 may have a center that is located anywhere relative to the plane of cymbal 521.

Figure 5D:
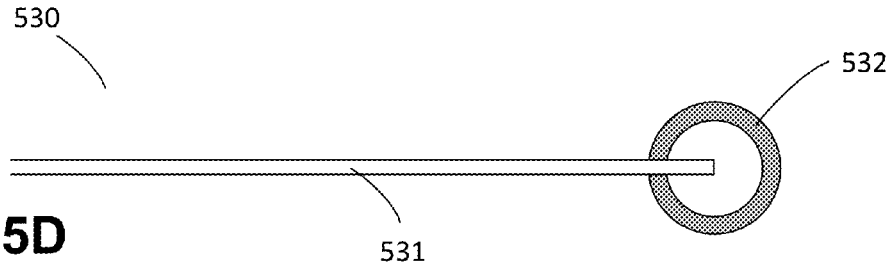

FIG. 5D depicts low volume cymbal 530 comprising cymbal 531 coupled to dampening element 532. Cymbal 531 may include any cymbal described herein, including a cymbal having any properties described above in connection with cymbal 101 shown in FIG. 1 and/or cymbal 201 shown in FIG. 2. For example, cymbal 531 may comprise a coating, perforations, or neither perforations nor a coating. Furthermore, low volume cymbal 530 may include any number of dampening elements, as dampening element 532 is provided as an example merely to indicate one possible form of the suitable dampening element.

In the example of FIG. 5D, dampening element 532 has a ring shape in cross section and is coupled to cymbal 531 at two points on opposing sides of cymbal 531. For example, dampening element 532 may be formed from a tube which has been cut open along its length and attached to cymbal 531. Dampening element 532 may be coupled via any suitable technique(s), including via one or more mechanical fasteners, and/or via a glue or other fixative, as described above. The thickness of the ring of dampening element 532 may have any suitable thickness relative to the diameter of the dampening element's cross section, such as between 1% and 50% of the diameter.

Dampening element 532 may be beneficial in use cases in which it is desirable for a dampening element to have a low mass. For example, a low mass dampening element may aid in lowering the volume of a cymbal while retaining some natural vibratory properties of the cymbal. Furthermore, dampening element 532 may make contact with cymbal 531 at fewer points than other exemplary dampening elements illustrated herein, which may allow a greater range of techniques to be used when coupling the dampening element to the cymbal.

Figure 6A:
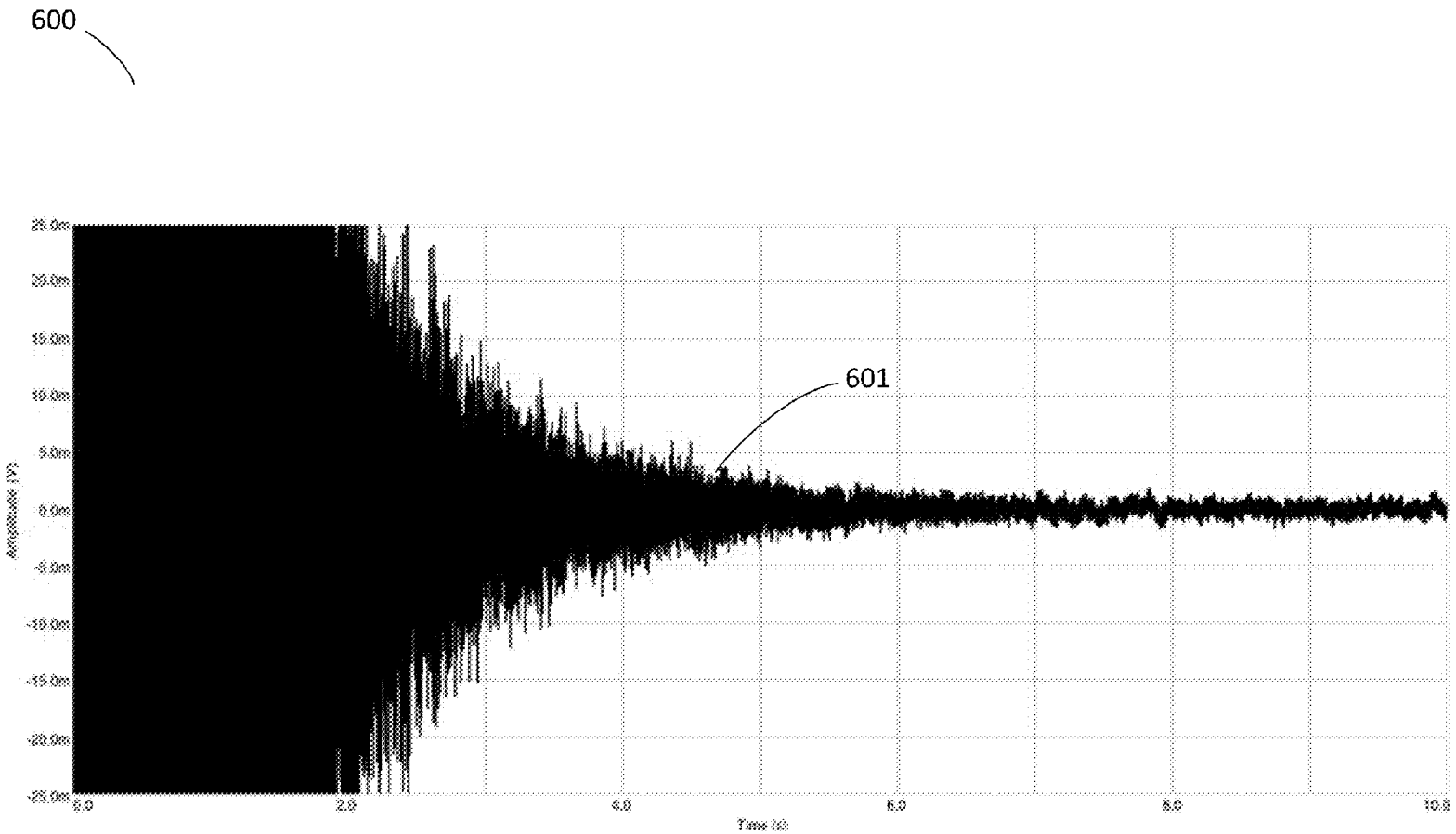
FIG. 6A illustrates an exemplary time-amplitude signal produced by a conventional acoustic cymbal, according to some embodiments.

FIG. 6A illustrates an exemplary time-amplitude signal produced by a conventional acoustic cymbal, according to some embodiments. Plot 600 includes signal 601, in which time is shown on the horizontal axis and the amplitude of the signal is shown on the vertical axis. It should be appreciated that the amplitude of signal 601 shown in FIG. 6A in the first two seconds exceeds the maximum amplitude displayed in the figure, but that the scale of FIG. 6A has been chosen to show the amplitude decay over several seconds, and accordingly the signal exceeds the displayed range in that part of the figure.

Signal 601 was generated by an exemplary conventional acoustic cymbal, and is provided merely to demonstrate a typical response of such a cymbal. It will be appreciated that there are many types and sizes of conventional acoustic cymbals, and that exemplary signal 601 is provided only to contrast the response of a representative conventional acoustic cymbal with the response of a low volume cymbal, as described herein. Furthermore, it will be appreciated that there are many ways to strike a conventional acoustic cymbal, and that one such exemplary strike has been chosen for this example.

In FIG. 6A, a strike of a cymbal occurs at time zero. Accordingly, signal 601 represents the vibrations of a cymbal that is substantially free to vibrate, as can be seen by the fact that the amplitude of the vibrations of the cymbal are sustained for at least five seconds after the strike. The length of this "sustain" feature is frequently associated with the playing feel of a traditional acoustic cymbal, which has a natural vibratory property such that a strike of the cymbal will result in a high-volume sound that decays over a period of seconds.

Figure 6B:
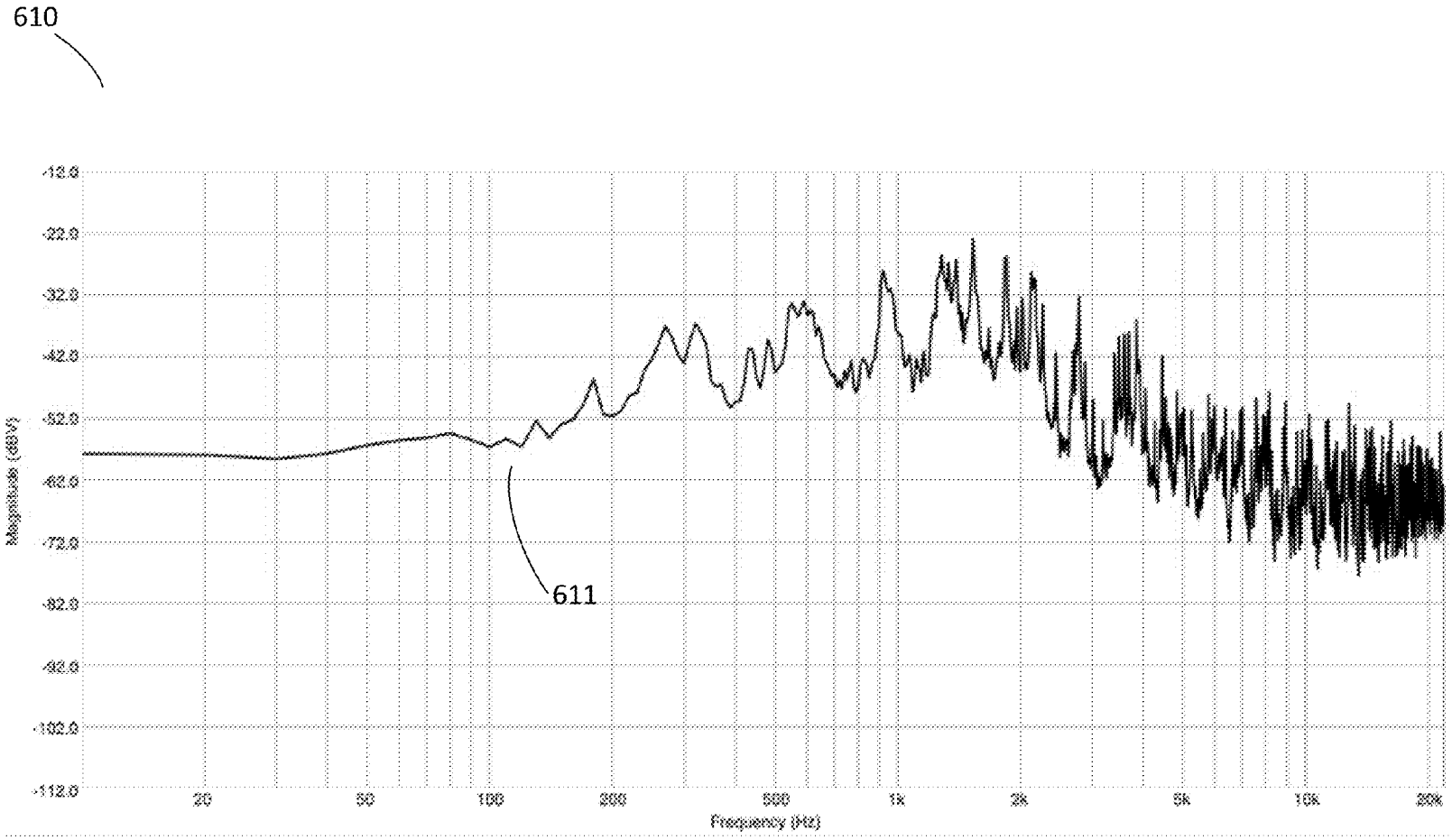
FIG. 6B illustrates a spectrogram corresponding to the exemplary time-amplitude signal shown in FIG. 6A, according to some embodiments.

FIG. 6B illustrates a spectrogram corresponding to the exemplary time-amplitude signal shown in FIG. 6A, according to some embodiments. Plot 610 includes signal 611, in which frequency is shown on the horizontal axis and a magnitude of the signal present at the corresponding frequency is shown on the vertical axis. Plot 610 and signal 611 illustrate that the strike of the cymbal shown in FIG. 6A includes frequencies of vibration from around 100 Hz up to 5 kHz and greater.

It can be seen that signal 611, which as indicated represents the frequency spectrum of signal 601, includes a high magnitude of sound above 1 kHz. This reflects a natural vibratory property of a metal cymbal to "ring" at high frequencies. In addition, a substantial magnitude of sound is present below 400 Hz. This lower frequency "hum" also reflects a natural vibratory property of a metal cymbal, in that the cymbal can sustain low-frequency vibrations for a period of time after a strike.

Figure 7A:
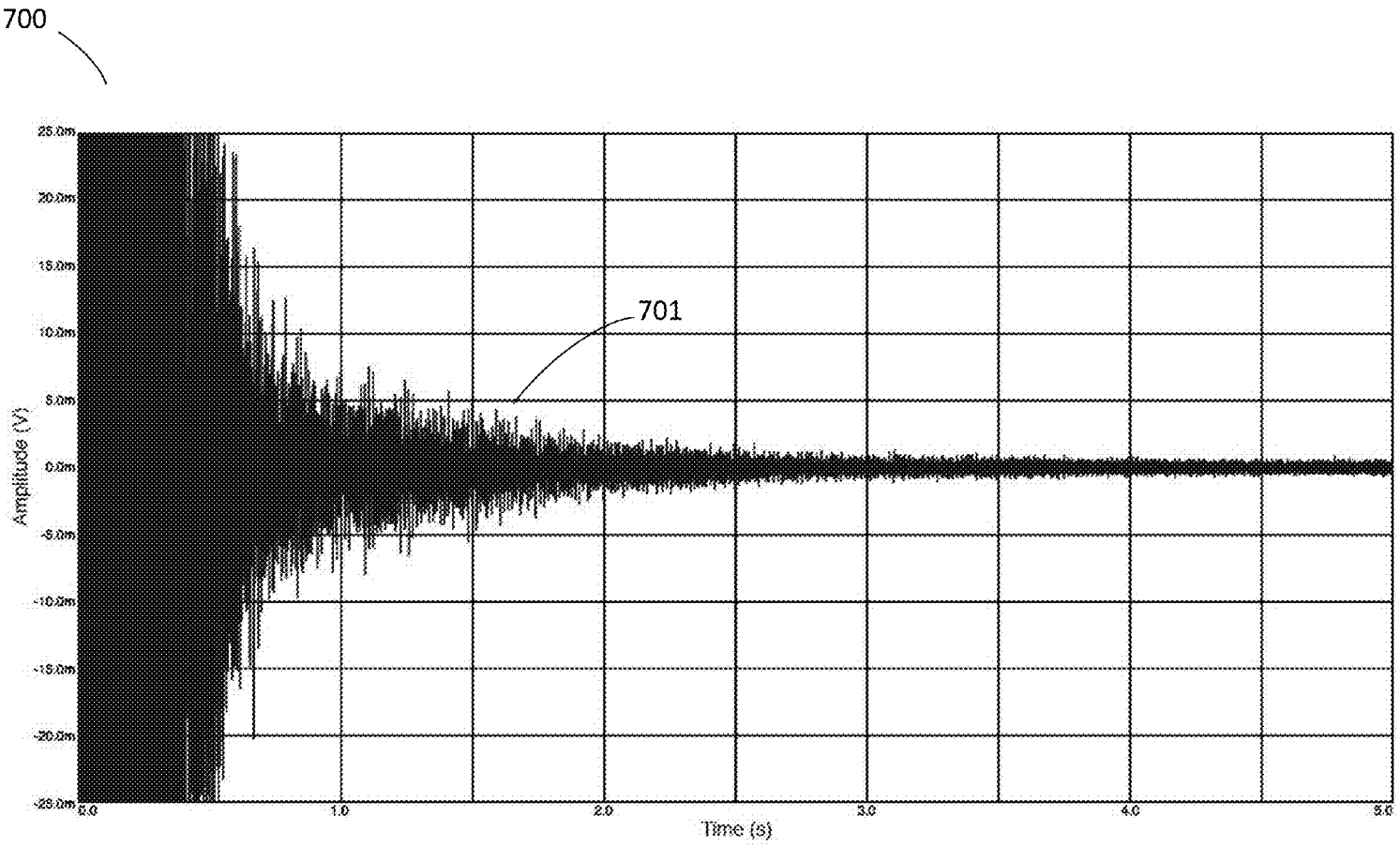
FIG. 7A illustrates an exemplary time-amplitude signal produced by an low volume cymbal, according to some embodiments.

FIG. 7A illustrates an exemplary time-amplitude signal produced by a low volume cymbal, according to some embodiments. Plot 700 includes signal 701, in which time is shown on the horizontal axis and the amplitude of the signal is shown on the vertical axis. It should be appreciated that the amplitude of signal 701 shown in FIG. 7A in the first 0.5 seconds exceeds the maximum amplitude displayed in the figure but that the scale of FIG. 7A has been chosen to show the amplitude decay over several seconds, and accordingly the signal exceeds the displayed range in that part of the figure.

Signal 701 was generated by a strike of an exemplary low volume cymbal having a dampening element as described herein (e.g., a coating and/or a circumferential dampening element). The exemplary low volume cymbal has substantially the same size and shape, and was struck in substantially the same manner with substantially the same force, as the exemplary conventional acoustic cymbal used to generate signal 601 shown in FIG. 6A.

In the example of FIG. 7A, a strike of a cymbal occurs at time zero. Accordingly, signal 701 represents the vibrations of the cymbal that is substantially free to vibrate, as can be seen by the fact that the amplitude of the vibrations of the cymbal are sustained for at least two to three seconds after the strike.

It can be seen from signal 701 that, while the sound produced by a strike of the exemplary low volume cymbal decays faster than the sound produced by the exemplary conventional acoustic cymbal in FIG. 6A, the decay is still far slower than would be observed in a comparable conventional low volume cymbal, which would decay to a negligible amplitude within a fraction of a second (e.g., less than 0.1 seconds). It will be noted that the horizontal scale of FIG. 7A ranges from 0 to 5 seconds, while the horizontal scale of FIG. 6A ranges from 0 to 10 seconds; these have been chosen to highlight the differences between the signals while providing a clear illustration of both signals.

It can further be noted that the low volume cymbal used to produce plot 700 shown in FIG. 7A produces less total sound than the conventional acoustic cymbal used to produce plot 600 shown in FIG. 6A, for example by examining the total area of signals 701 and 601 and by noting that the area of signal 601 is substantially less than that of signal 701.

Figure 7B:
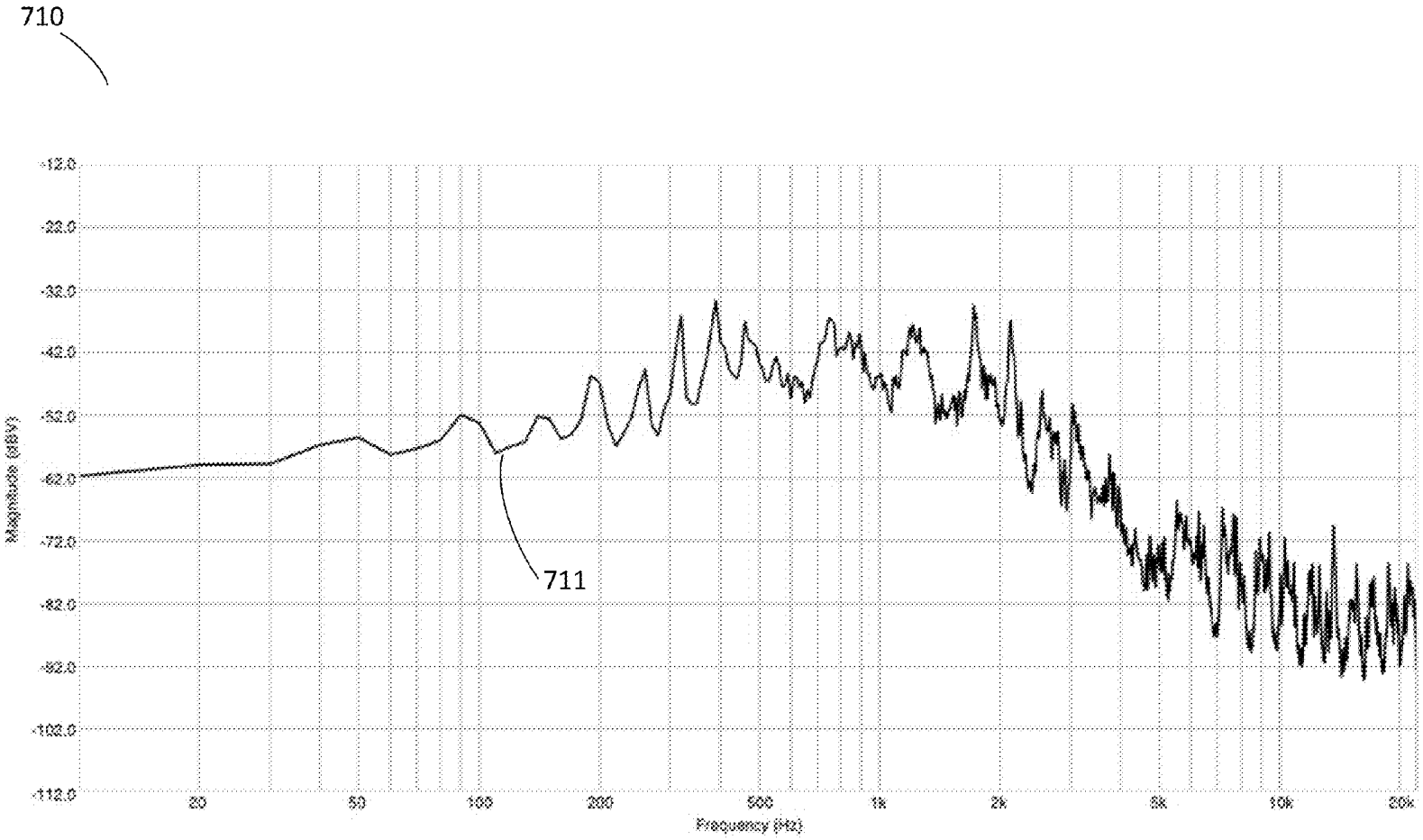
FIG. 7B illustrates a spectrogram corresponding to the exemplary time-amplitude signal shown in FIG. 7A, according to some embodiments.

FIG. 7B illustrates a spectrogram corresponding to the exemplary time-amplitude signal shown in FIG. 7A, according to some embodiments. Plot 710 includes signal 711, in which frequency is shown on the horizontal axis and a magnitude of the signal present at the corresponding frequency is shown on the vertical axis. Plot 710 and signal 711 illustrates that the strike of the cymbal shown in FIG. 7A includes frequencies of vibration from around 100 Hz up to 5 kHz and greater.

In comparing signal 711 shown in FIG. 7B with signal 611 shown in FIG. 6B, it may be noted that the frequency spectrum exhibited by signal 711 is substantially similar to the frequency spectrum exhibited by signal 611. While there are differences between the frequency spectra, features such as, but not limited to, the magnitudes present in the 500 Hz to 2 kHz range, and/or the magnitudes present in the 200-500 Hz range are substantially similar. Therefore, it can be seen that the exemplary low volume cymbal used to produce plots 700 and 710 shown in FIGS. 7A and 7B, respectively, provides a lower amplitude sound than a comparable conventional acoustic cymbal when struck, yet exhibits some natural vibratory properties of the conventional acoustic cymbal.

Figure 8:
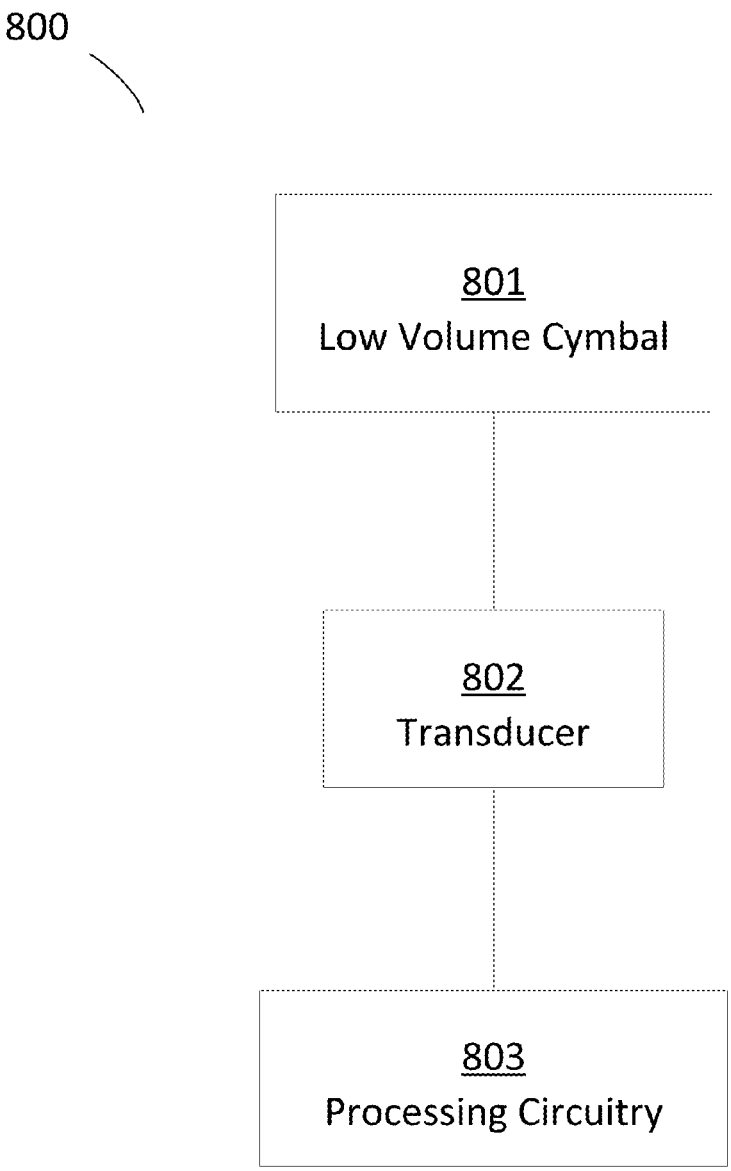
FIG. 8 illustrates a block diagram of an exemplary system for determining a manner in which a low volume cymbal was struck, according to some embodiments.

FIG. 8 illustrates a block diagram of an exemplary system for determining a manner in which a low volume cymbal was struck, according to some embodiments. System 800 includes low volume cymbal 801, transducer 802 and processing circuitry 803.

Low volume cymbal 801 may include any low volume cymbal described herein, including low volume cymbals 100, 200, 300, 400, 500, 510, 520 and/or 530. For example, low volume cymbal 801 may comprise a coating, perforations, and/or a circumferential dampening element, or none of these. Low volume cymbal 801 is coupled to transducer 802. In some embodiments, low volume cymbal 801 is mechanically coupled to transducer 802 such that an acoustic signal resulting from a strike of the cymbal is detected by the transducer. For example, transducer 802 may comprise an accelerometer and/or a piezoelectric element. In some embodiments, transducer 802 is coupled acoustically to low volume cymbal 801 such that an acoustic signal produced by the cymbal is measured by the transducer. For example, transducer 802 may comprise a microphone.

Regardless of how transducer 802 is coupled to low volume cymbal 801, the transducer is configured such that, when low volume cymbal 801 is struck, the transducer detects an acoustic signal generated by the strike. Transducer 802 converts the detected acoustic signal into an electrical signal that represents one or more aspects of the acoustic signal generated by the low volume cymbal strike. The electrical signal may comprise any suitable representation or representations of the acoustic signal, which may include any analog and/or digital representations. The electrical signal is sent from transducer 802 to processing circuitry 803. Transducer 802 and processing circuitry 803 may be enclosed within a single housing, or may be physically distinct elements of system 800 (though may be coupled together via physical means or otherwise).

Processing circuitry 803 determines a manner in which low volume cymbal 801 was struck based on the electrical signal received from transducer 802. Processing circuitry 803 may make this determination in any suitable way, and by using any aspect or aspects of the received electrical signal. In some embodiments, one or more of the following aspects of the electrical signal are used: an amplitude, a frequency, a rise time, and/or combinations thereof. It will be appreciated, however, that in general any aspects, and any number of aspects, may be used to make a determination of a manner in which low volume cymbal 801 was struck based on the electrical signal received from transducer 802. For example, a peak amplitude and an amplitude at a particular time after a strike of the low volume cymbal (including at the time of the strike) may both be used to determine a manner in which the low volume cymbal was struck. Alternatively, or additionally, more than one frequency may be identified, for example based on a power spectrum of the acoustic signal, and used to determine a manner in which the low volume cymbal was struck. Furthermore, aspects of the electrical signal received from transducer 802 may be modified in any way and any number of times by processing circuitry 803 in determining a manner in which low volume cymbal 801 was struck. For example, one or more aspects of the electrical signal may be transformed by processing circuitry 803 and an amplitude of a transformed signal may be used in determining a manner in which low volume cymbal 801 was struck.

In some embodiments, processing circuitry 803 may perform attenuation of one or more frequency components of the electrical signal received from transducer 802, and may determine a manner in which low volume cymbal 801 was struck based at least in part on an attenuated signal. For example, processing circuitry 803 may attenuate aspects of the electrical signal below a particular frequency (e.g., using a high pass filter) and use transmitted aspects of the electrical signal to determine a manner in which low volume cymbal 801 was struck. Processing circuitry 803 may perform such an attenuation any number of times and using any suitable analog and/or digital components. As a non-limiting example, processing circuitry 803 may attenuate aspects of the electrical signal below a first frequency thus producing a first signal, and additionally may attenuate aspects of the electrical signal above a second frequency thus producing a second signal, and may use the first signal and/or the second signal in determining a manner in which low volume cymbal 801 was struck. In some embodiments, processing circuitry 803 may perform attenuation of signals generated by one or more components of the processing circuitry.

The inventors have recognized and appreciated that by determining a manner in which low volume cymbal 801 is struck based on an acoustic signal detected by transducer 802, a cymbal articulation corresponding to the strike may be identified by processing circuitry 803. As non-limiting examples, it has been observed that an acoustic signal resulting from a bell strike may have a quickly rising amplitude, and may have a high peak amplitude; an acoustic signal resulting from a bow strike may have a quickly rising amplitude but may have a lower peak amplitude than a bell strike; an acoustic signal resulting from an edge strike may contain a significant low-frequency component; and an acoustic signal resulting from a choke may be recognized by a fast drop in amplitude. However, these are provided as examples only and in general any suitable aspects of an acoustic signal detected by transducer 802 may be used to identify any type of cymbal articulation, including the articulations noted above. Furthermore, it will be appreciated that circuitry to identify qualities of the electrical signal generated by transducer 802 may be created in any suitable way and may include any number of analog and/or digital components.

In some embodiments, processing circuitry 803 includes one or more analog components. For example, processing circuitry 803 may include one or more filters (including band pass, low pass, high pass, notch and/or roll-off filters), peak detectors, envelope detectors, operational amplifiers, analog-to-digital converters, digital to analog converters, or combinations thereof.

In some embodiments, processing circuitry 803 includes one or more digital components. For example, processing circuitry 803 may include one or more processors, one or more Application Specific Integrated Circuits (ASICs), one or more Field Programmable Gate Arrays (FPGAs), one or more microcontrollers, or combinations thereof. Processing circuitry 803 may include any number of interfaces configured to connect to external devices. For example, processing circuitry 803 may include one or more ports that may be connected to a computer or other device. Furthermore, processing circuitry 803 may include, or may have access to, any number of storage devices of any suitable type, including but not limited to RAM, ROM, Flash memory, and/or combinations thereof.

In some embodiments, processing circuitry 803 may be coupled to more than one transducer. For example, a plurality of low volume cymbals each coupled to a transducer may be coupled to processing circuitry 803. In such embodiments, processing circuitry 803 may include a plurality of channels.

Transducer 802 and/or processing circuitry 803 may be coupled to one or more switches whose position affects the detection of an acoustic signal by transducer 802 and/or the processing of an electrical signal by processing circuitry 803. For example, transducer 802 may produce an electrical signal based at least in part on the position of a switch, such as by adjusting the amplitude and/or frequency response of the transducer based on said position.

Alternatively, or additionally, processing circuitry 803 may perform an analysis of a manner in which low volume cymbal 801 was struck based at least in part on the position of a switch. In some embodiments, a switch indicates a type of low volume cymbal to which transducer 802 and/or processing circuitry 803 is coupled. For example, a suitable switch may have one or more settings indicating that an associated low volume cymbal is a ride cymbal, a crash cymbal, and/or a hi-hat. In such embodiments, processing circuitry 803 may identify a manner in which low volume cymbal 801 was struck based at least in part on the cymbal type currently selected by the switch. Such a switch may be provided in any suitable location, such as on a housing coupled to transducer 802, and/or a housing coupled to processing circuitry 803.

In some embodiments, processing circuitry 803 may determine a manner in which low volume cymbal 801 was struck based at least in part on one or more variables defined by a user. Such variables may be related to the type of low volume cymbal 801, and/or may represent playing preferences expressed by the user. In some embodiments, such variables may be input to processing circuitry 803 using any suitable interface to which the processing circuitry is coupled, including but not limited to an attached computer. Alternatively or additionally, such user-defined variables may be stored in a storage device coupled to, or otherwise accessible to, processing circuitry 803.

In some embodiments, processing circuitry 803 may perform digital sampling of an electrical signal received from transducer 802, and/or may perform digital sampling of signals derived from the electrical signal. Such digital sampling may be performed at any suitable sampling rate, including but not limited to 20 kHz, 44.1 kHz, 48 kHz, and/or 96 kHz. Furthermore digital sampling formed by processing circuitry 803 may utilize any suitable modulation techniques, including Pulse Code Modulation (PCM), and/or may use any suitable bit depth, including but not limited to 8-bit, 16-bit and/or 24-bit.

In some embodiments, processing circuitry 803 may store, or otherwise have access to, one or more threshold values, any number of which may be used in determining a manner in which low volume cymbal 801 was struck. Threshold values may correspond to, for example, amplitude thresholds that may be used in determining a manner in which low volume cymbal 801 was struck. As a non-limiting example, an amplitude above which a signal may be identified as corresponding to a bell strike of low volume cymbal 801 may differ from amplitude above which a signal may be identified as corresponding to a bow strike.

In some embodiments, the magnitude of one or more threshold values used by processing circuitry 803 may depend on one or more characteristics of low volume cymbal 801 and/or transducer 802. For example, the type of low volume cymbal 801 (e.g., a crash cymbal or a ride cymbal) may be determinative of one or more threshold values. This may, for example, allow for identification of a manner in which a cymbal was struck to be tailored to the particular type of cymbal (e.g., a threshold relating to identification of an edge strike on a ride cymbal may differ from a threshold relating to identification of an edge strike on a crash cymbal). Alternatively, or additionally, one or more characteristics of transducer 802 may be determinative of one or more threshold values, for example a gain of the transducer. Irrespective of how one or more threshold values used by processing circuitry 803 may depend on one or more characteristics of low volume cymbal 801 and/or transducer 802, such threshold values may be effected in any suitable way, including by providing the values to processing circuitry 803 from a device coupled to the processing circuitry, and/or by processing circuitry 803 accessing a suitable storage device.

In some embodiments, processing circuitry 803 may determine a manner in which low volume cymbal 801 was struck by identifying a zone in which the low volume cymbal was struck. The zones may be physical regions of low volume cymbal 801 (e.g., the bow region) and/or may be conceptual ways in which the low volume cymbal may be struck (e.g., hard versus soft strikes). For example, processing circuitry 803 may identify whether a low volume cymbal was struck in a bell zone or whether the low volume cymbal was struck along an edge. In such an example, processing circuitry 803 may be configured to identify a manner in which the low volume cymbal was struck based on this "two zone" approach, that is to determine, for a strike, which of the two zones generated the strike. In general, however, processing circuitry 803 may be configured to identify a manner in which low volume cymbal 801 was struck based on any number and any type of zones, and furthermore may be configured to perform multiple such analyses (e.g., to perform a two zone analysis in addition to a three zone analysis).

Figure 9:
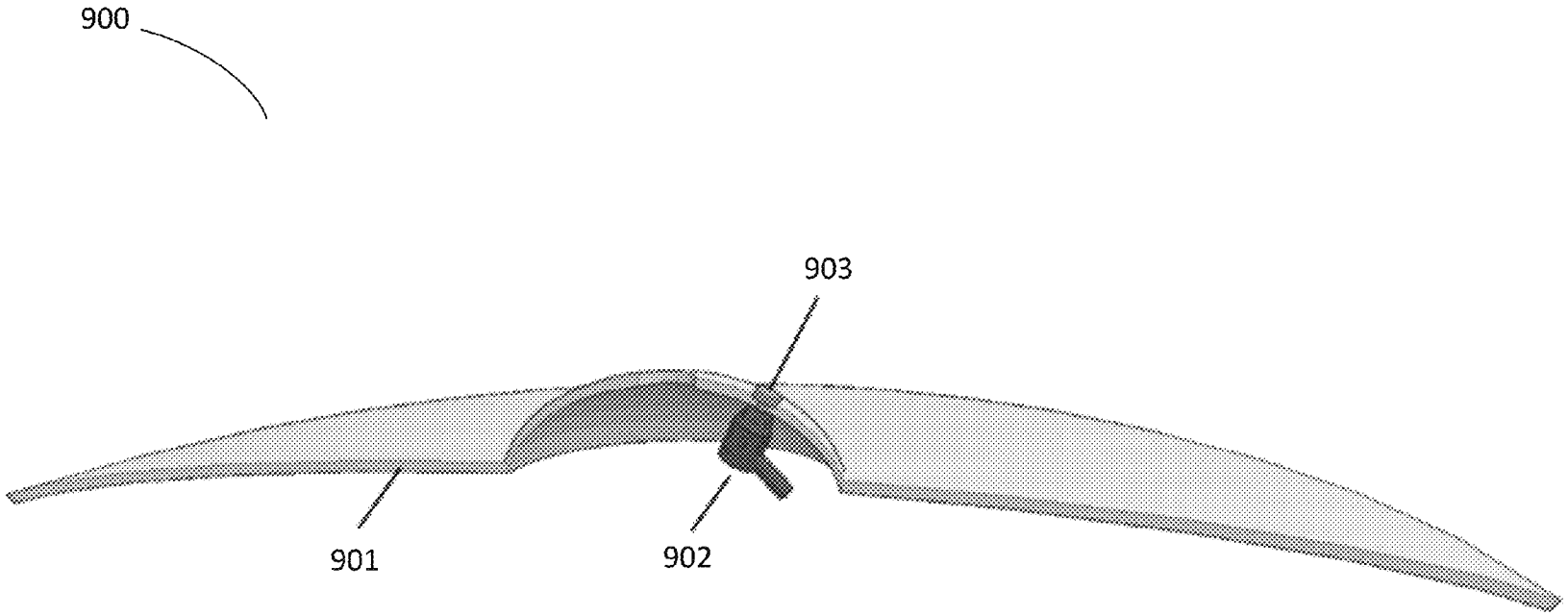
FIG. 9 illustrates a cross-section of an exemplary low volume cymbal coupled to a transducer, according to some embodiments.

FIG. 9 illustrates a cross-section of an exemplary low volume cymbal coupled to a transducer, according to some embodiments. Cymbal system 900 includes low volume cymbal 901 coupled to transducer 902 via coupler 903. Low volume cymbal 901 may include any low volume cymbal described herein, including low volume cymbals 100, 200, 300, 400, 500, 510, 520, 530 and/or 801. For example, low volume cymbal 901 may comprise a coating, perforations, and/or a circumferential dampening element, or none of these.

Transducer 902 may be any suitable device able to convert acoustic waves generated by a strike of the cymbal (e.g., in the air and/or in the cymbal) into another form of energy. In some embodiments, transducer 902 is a vibratory transducer configured to convert vibratory energy into electrical energy. However, in general transducer 902 may include any suitable piezoelectric, capacitive and/or electromagnetic transduction technology or technologies. In some embodiments, transducer includes one or more aspects of transducer 802 discussed above in relation to FIG. 8.

In some embodiments, transducer 902 is mechanically coupled to low volume cymbal 901 such that it moves in concert with the cymbal when it is struck, and vibrations of low volume cymbal 901 may be detected by transducer 902. In some embodiments, transducer 902 comprises an accelerometer, including, but not limited to, a capacitive accelerometer.

Transducer 902 may be positioned anywhere in relation to low volume cymbal 901 such that acoustic waves resulting from a strike of the cymbal may be received by the transducer. For example, transducer 902 may not be mechanically coupled to low volume cymbal 901 but may instead be located near the cymbal such that acoustic waves generated in the air by a strike of the cymbal are detected by the transducer. However, in the example of FIG. 9, transducer 902 is mechanically coupled to cymbal low volume 901 via coupler 903. Coupler 903 may comprise any suitable means of attachment such that an acoustic signal generated by strike of low volume cymbal 901 is detected by transducer 902. For example, coupler 903 may comprise a screw passed through a hole in low volume cymbal 901.

In some embodiments, transducer 902 may be configured so as not to detect acoustic signals other than those generated by a strike of cymbal low volume 901. For example, transducer 902 may be an accelerometer mechanically coupled to cymbal 901 and/or otherwise mechanically isolated so as to only detect motion of the cymbal.

When low volume cymbal 901 is struck, an acoustic signal detected by transducer 902 may be used to identify a manner in which the cymbal was struck, as described above. For example, the acoustic signal detected by transducer 902 may identify a location of the strike on the cymbal and/or may indicate a force with which the cymbal was struck. In some embodiments, it may be beneficial for transducer 902 to have a wide bandwidth and high sensitivity so as to maximize the ability of the transducer to identify the manner in which cymbal was struck.

In some embodiments, when low volume cymbal 901 is struck an acoustic signal detected by transducer 902 may be used to identify a cymbal articulation corresponding to the strike. For example, the acoustic signal may be used to identify a bell strike or an edge strike, as described above. As discussed above, cymbal 901 having a low volume may aid in analysis of an acoustic signal generated by a strike of low volume cymbal 901 and detected by transducer 902, since for example the acoustic signal may have a simpler form.

Figure 10:
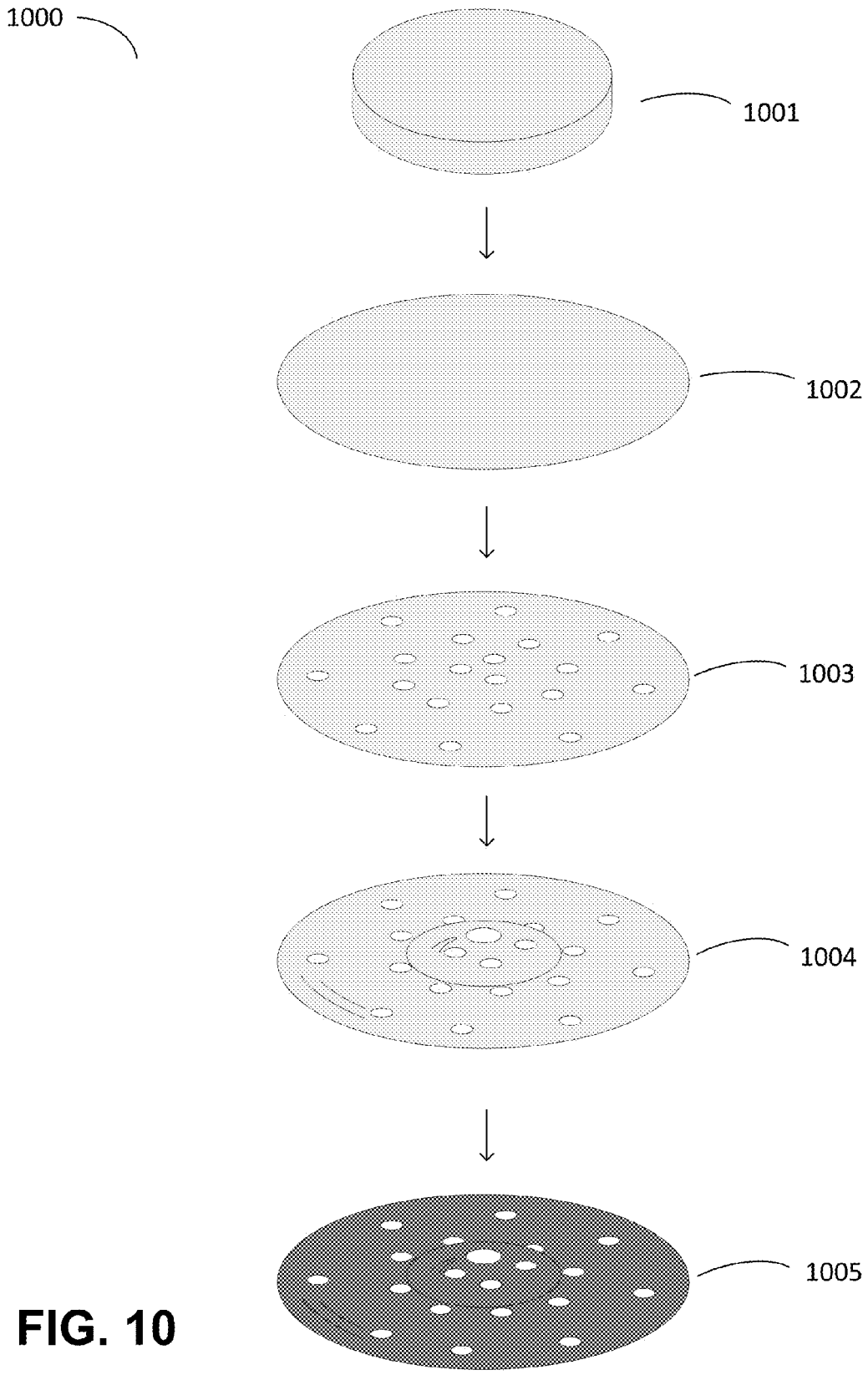
FIG. 10 illustrates a method of manufacturing a first low volume cymbal, according to some embodiments.

FIG. 10 illustrates a method of manufacturing a first low volume cymbal, according to some embodiments. Some of the steps illustrated in method 1000 are similar, and/or substantially identical to, steps that may be followed in the production of a conventional acoustic cymbal. Accordingly, any suitable steps and/or techniques that may be employed in the production of a conventional acoustic cymbal may be utilized in method 1000. Additionally, one or more novel techniques may be utilized, as discussed below. It will be appreciated that while not every possible technique that may be utilized to produce the low volume cymbal described herein is described below, any suitable technique or techniques known to those skilled in the art may be employed in the process of manufacturing the cymbal, including both those discussed below and any not discussed below.

Method 1000 begins with step 1001 in which a slab of metal from which a cymbal will be made, is formed and/or provided. The slab of metal may comprise any suitable material, such as any bronze alloy (including B8 and/or B20 bronze, etc.) and/or steel (including low carbon steel). The slab of metal in step 1001 may be provided in any suitable way, including by melting (e.g. by melting and casting bronze and/or steel) and/or by rolling metal into a slab.

In step 1002, the metal slab is rolled or otherwise shaped into the general shape of the cymbal being formed. For example, the metal slab may be rolled into a flatter disc and then cut into the shape of a circle. Step 1002 may be performed in any suitable way, including by heating up metal slabs prior to rolling. Any number of rolling operations may be performed, and in any number of directions. For example, the metal slab may be rolled a plurality of times in different directions before it is cut.

In step 1003, one or more perforations are made into the metal disc formed in step 1002. The perforations may be formed in any suitable way, including by using a hydraulic press to punch holes in the metal disc. The location(s) of the perforations may be chosen, at least in part, to reduce the volume of the resulting cymbal while retaining some natural vibratory properties of the metal disc, as described herein.

In step 1004, the perforated metal disc is shaped into the final shape of the low volume cymbal. Shaping may include, but is not limited to, cupping (forming a cup or bell shape in the center of the cymbal), lathing (e.g. shaving metal from the surface of the cymbal), hammering, backbending, pressing, buffing, or any combination thereof, in any suitable sequence.

In step 1005, a coating is applied to the low volume cymbal formed in step 1004. The coating may include any coating described herein, including a coating having any properties described above in connection with coating 102 shown in FIG. 1. The coating may be applied in any suitable manner, and may include, but is not limited to, plating (including vapor deposition and/or metallizing), gluing, painting (including any method of applying a paint, pigment, or other medium to the surface of the cymbal), or any combination thereof.

The resulting coated low volume cymbal may exhibit and/or include any aspect(s) described above in relation to low volume cymbal 200 shown in FIG. 2.

Figure 11:
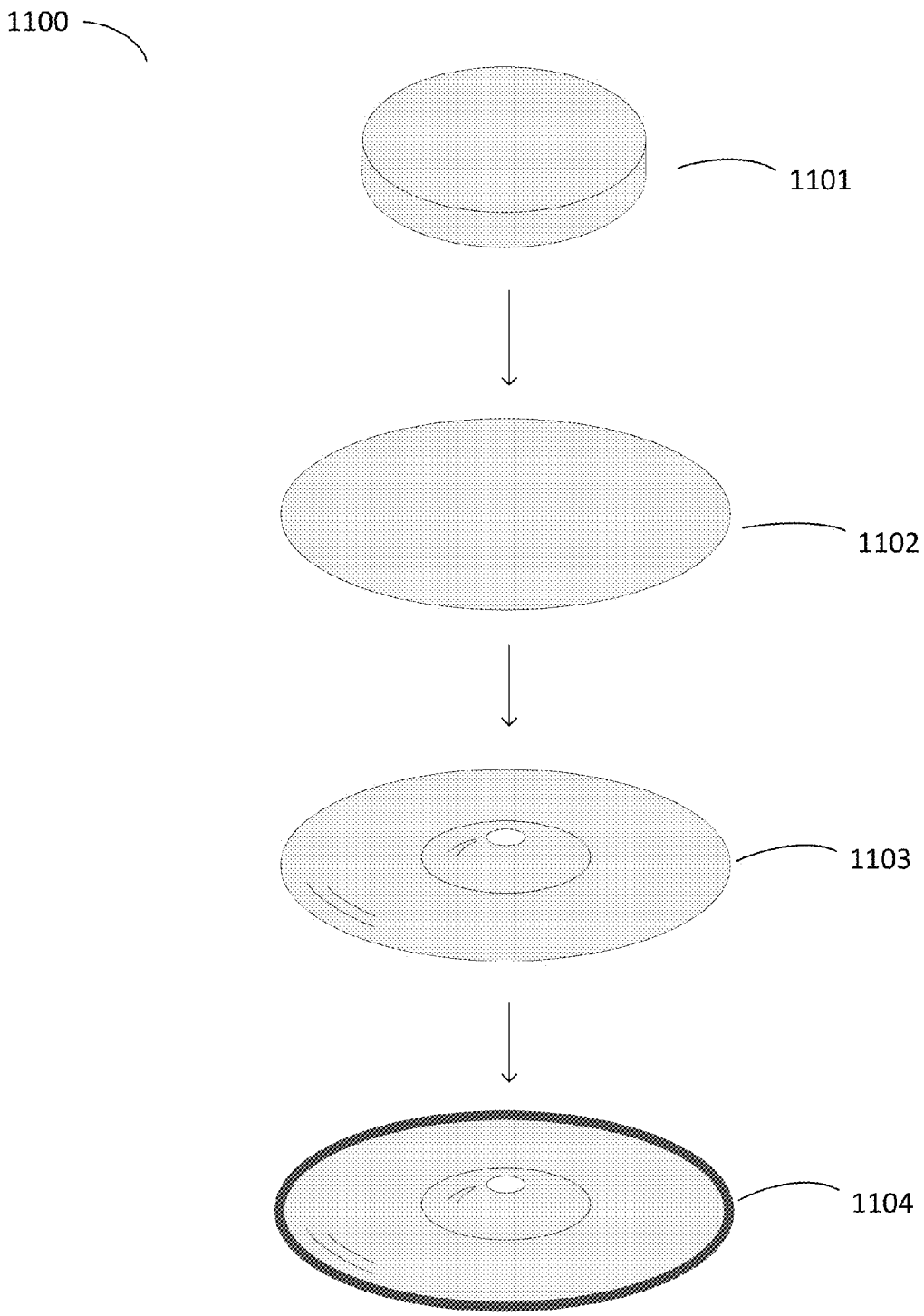
FIG. 11 illustrates a method of manufacturing a second low volume cymbal, according to some embodiments.

FIG. 11 illustrates a method of manufacturing a second low volume cymbal, according to some embodiments. Some of the steps illustrated in method 1100 are similar, and/or substantially identical to, steps that may be followed in the production of a conventional acoustic cymbal. Accordingly, any suitable steps and/or techniques that may be employed in the production of a conventional acoustic cymbal may be utilized in method 1100. Alternatively, or additionally, one or more novel techniques may be utilized, as discussed below. It will be appreciated that while not every possible way to produce the first low volume cymbal described herein is provided below, any suitable technique or techniques known to those skilled in the art may be employed in the process of manufacturing the cymbal, including both those discussed below and any not discussed below.

Method 1100 begins with step 1101 in which a slab of metal from which a cymbal will be made, is formed and/or provided. The slab metal may comprise any suitable material, such as any bronze alloy (including B8 and/or B20 bronze, etc.) and/or steel (including low carbon steel). The slab of metal in step 1101 may be provided in any suitable way, including by melting (e.g. by melting and casting bronze and/or steel) and/or by rolling metal into a slab.

In step 1102, the metal slab is rolled or otherwise shaped into the general shape of the cymbal being formed. For example, the metal slab may be rolled into a flatter disc and then cut into the shape of a circle. Step 1102 may be performed in any suitable way, including by heating up metal slabs prior to rolling. Any number of rolling operations may be performed, and in any number of directions. For example, the metal slab may be rolled a plurality of times in different directions before it is cut.

In step 1103, the metal disc is shaped into the final shape of the low volume cymbal. Shaping may include, but is not limited to, cupping (forming a cup or bell shape in the center of the cymbal), lathing (e.g. shaving metal from the surface of the cymbal), hammering, backbending, pressing, buffing, or any combination thereof, in any suitable sequence.

In step 1104, a dampening element in the form of a circumferential ring is attached to the cymbal. In particular, the dampening element contacts the exterior circumference of the cymbal. The dampening element may include any dampening element described herein, including any dampening element described in FIGS. 3A-B, 4A-B and/or 5A-D. For example, while the dampening element depicted in FIG. 11 is shown as a ring shape, the dampening element may have the form of an arc and/or may be attached to an upper or lower surface of the cymbal only, as described above for certain embodiments. The dampening element may be coupled to the cymbal in any suitable manner, which may include, but is not limited to, via one or more mechanical fasteners, and/or via a glue or other fixative, as described above.

The resulting dampened low volume cymbal may exhibit and/or include any aspect(s) described above in relation to low volume cymbal 300 shown in FIGS. 3A-B, low volume cymbal 400 shown in FIGS. 4A-B, and/or low volume cymbals 500, 510, 520 or 530 shown in FIGS. 5A-D.

Having herein described several embodiments, several advantages of embodiments of the present application should be apparent. One advantage is that embodiments may allow for a low volume cymbal suitable for low volume practice and/or for electronic detection of sounds generated by the cymbal, that offers a playing feel substantially similar, or identical to, that of a traditional acoustic cymbal.

It should be appreciated that the cymbal and its components described herein may have any suitable dimensions, and embodiments of the cymbal are not limited to any dimensions or shapes indicated above. For example, a cymbal suitable for use with embodiments described herein may have a size ranging anywhere from 6" to several feet, and may have any suitable shape. In particular, cymbals either with or without a "bell" or "cup" region may be used with embodiments described herein, as while embodiments described herein make reference to those features of cymbals, the techniques and methods described herein are not limited to use with cymbals having such features.

Aspects of the low volume cymbal described herein may be implemented to recognize any cymbal articulations corresponding to any type of strike of a cymbal. For example, while some articulations resulting from drum sticks have been described herein, the various methods and structures described herein may be used with articulations created by any suitable striking method, such as by using hands or other body parts, brushes and/or mallets to strike a cymbal. It will further be appreciated that cymbal articulations other than those described herein may be detected and/or identified by utilizing the various methods and structures described herein. For example, a strike of a cymbal stand or other apparatus to which a cymbal is coupled may be identified as a cymbal articulation. In some embodiments, one or more cymbal articulations differ in the object used to strike the cymbal, and do not necessarily differ in the location of the strike on the cymbal. For example, a brush and a stick strike of one region of one particular cymbal may be identified as distinct cymbal articulations of a low volume cymbal.

The various methods and structures outlined herein may be implemented using any suitable materials. While particular materials and methods are described above, the methods and structures can be readily implemented using any combination of materials having suitable properties for practicing embodiments described herein. In particular, cymbals suitable for use with embodiments described herein may comprise any metal, including but not limited to, any type of bronze (including B8 and B20 alloys, and any combination thereof), any type of steel (including low carbon steel), or combinations thereof.

Various inventive concepts may be embodied as one or more methods, of which examples have been provided. For example, methods of producing a low volume cymbal have been provided herein. The acts performed as part of any method described herein may be ordered in any suitable way. Accordingly, embodiments may be constructed in which acts are performed in an order different than illustrated, which may include performing some acts simultaneously, even though these acts may have been shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein, unless clearly indicated to the contrary, should be understood to mean "at least one."

As used herein, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

The phrase "and/or," as used herein, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

The phraseology and terminology used herein is for the purpose of description and should not be regarded as limiting. The use of "including," "comprising," "having," "containing", "involving", and variations thereof, is meant to encompass the items listed thereafter and additional items.

Having described several embodiments of the invention in detail, various modifications and improvements will readily occur to those skilled in the art.

For example, techniques of producing and operating a low volume cymbal were described. These techniques may be applied in other contexts. For example, reducing the volume of any metal while retaining some natural vibratory properties of the metal may use techniques as described herein. Such modifications and improvements are intended to be within the spirit and scope of the invention. Accordingly, the foregoing description is by way of example only, and is not intended as limiting.

What is claimed is:

1. A cymbal comprising:

a metal plate having a plurality of perforations therein and including a cup-shaped region; and a coating of a resilient material in contact with the metal plate that covers at least a portion of the surface of the metal plate.

2. The cymbal of claim 1, wherein the metal plate comprises bronze.

3. The cymbal of claim 2, wherein the bronze comprises at least 90% copper.

4. The cymbal of claim 1, wherein the coating comprises a protective layer and a second layer, and wherein the second layer is in contact with the protective layer and the metal plate.

5. The cymbal of claim 1, wherein the coating comprises one or more of: a pigment, a dye or a resin.

6. The cymbal of claim 1, further including a sensor coupled to the metal plate configured to detect an acoustic signal generated by a strike of the metal plate.

7. The cymbal of claim 6, wherein the sensor includes a transducer.

8. The cymbal of claim 7, wherein the transducer includes at least one of: a capacitive component, a piezoelectric component and/or an electromagnetic component.

9. The cymbal of claim 6, further including processing circuitry coupled to the sensor configured to process electronic information received from the sensor to determine a cymbal articulation for the strike of the metal plate based on an acoustic signal.

10. A cymbal comprising:

a metal plate; and one or more dampening elements each attached to at least a portion of the circumference of the metal plate and each in contact with an upper surface of the metal plate and a lower surface of the metal plate.

11. The cymbal of claim 10, wherein the dampening element is entirely located within an annular area having an outer radius equal to a radius of the metal plate and an inner radius equal to 90% of the radius of the metal plate.

12. The cymbal of claim 10, wherein the metal plate comprises bronze.

13. The cymbal of claim 10, wherein the dampening element forms an arc.

14. The cymbal of claim 1, wherein the coating comprises a metal plating.

15. A method of producing a cymbal, comprising:

forming a metal plate having a plurality of perforations therein and including a cup-shaped region; and forming a resilient coating over at least a portion of the surface of the metal plate and in contact with the metal plate.

16. The method of claim 15, wherein the resilient coating comprises a protective layer and a second layer, and wherein the second layer is in contact with the protective layer and the metal plate.

17. The method of claim 15, wherein the metal plate comprises bronze.

18. The method of claim 17, wherein the bronze comprises at least 90% copper.

19. The method of claim 15, wherein the resilient coating comprises one or more of: a pigment, a dye or a resin.

20. The method of claim 15, wherein the resilient coating comprises a metal plating.

* * * * *